US006409043B1

(12) United States Patent
Fujita et al.

(10) Patent No.: US 6,409,043 B1
(45) Date of Patent: Jun. 25, 2002

(54) SHEET CONVEYING APPARATUS

(75) Inventors: Takashi Fujita, Shizuoka-ken; Shigeo Doi, Numazu, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/419,094

(22) Filed: Oct. 15, 1999

(30) Foreign Application Priority Data

Oct. 19, 1998 (JP) ..... 10-296575
Jan. 6, 1999 (JP) ..... 11-001491

(51) Int. Cl.[7] ..... B65H 5/00

(52) U.S. Cl. ..... 221/10.03; 271/266; 271/270; 271/182; 271/202; 271/283

(58) Field of Search ..... 271/229, 265, 271/270, 266, 182, 202, 283, 10.03; 399/396

(56) References Cited

U.S. PATENT DOCUMENTS 4,451,030 A * 5/1984 Teeter et al. ..... 271/265
4,508,444 A * 4/1985 May et al. ..... 355/3 X

* cited by examiner

*Primary Examiner*—David H. Bollinger
*Assistant Examiner*—Kenneth W Bower
(74) *Attorney, Agent, or Firm*—Fitzpatrick, Cella, Harper & Scinto

(57) ABSTRACT

The present invention provides a sheet conveying apparatus comprising a sheet feeding device for separating and feeding stacked sheets one by one, a convey guide device for guiding the sheet fed out by the sheet feeding device, a spacing device provided on the guide device and adapted to deviate positions of a trailing end of a preceding sheet and a leading end of a succeeding sheet which is fed continuously to the preceding sheet, a sheet detecting device for detecting the leading end of the succeeding sheet deviated from the trailing end of the preceding sheet by the spacing device.

19 Claims, 18 Drawing Sheets

SHEET CONVEYING APPARATUS

BACKGROUND OF THE INVENTION

1. Field of the Invention

The present invention relates to a sheet conveying apparatus for conveying a cut sheet in an image forming apparatus such as a printer, a facsimile, a copying machine, a printing device and the like.

2. Related Background Art

In image forming apparatuses such as copying machines, printers, facsimiles and the like, there has widely been used an apparatus for fixing a non-fixed toner image formed on a material to be recorded (for example, a paper sheet such as transfer material, photosensitive paper, electrostatic recording paper and printing paper) in correspondence to image information with a transfer system (indirect system) or a direct system by using an appropriate imaging process mechanism of electrophotographic type, electrostatic type or magnetic recording type.

Further, there has been used an apparatus (of ink jet type, for example) for directly forming an image on a material to be recorded, by using liquid including dye or/and pigment.

As a sheet conveying apparatus for conveying the material to be recorded (referred to as "sheet" hereinafter) in the above-mentioned apparatuses, there is a sheet conveying apparatus of automatic feeding type in which one cassette corresponding to desired sheet kind or sheet size is selected among a plurality of sheet feeding cassettes each containing sheets and a sheet is fed out one by one from such a sheet feeding cassette in synchronous with an image forming operation.

In such a sheet conveying apparatus, the following sheet detecting means have widely been used as a means for detecting sheet jam or detecting a leading end or a trailing end of the sheet.

A. Lever Type

As shown in FIG. 22A, a leading end of a sheet P conveyed along between guides G falls a lever L down so that an photo-interrupter I is blocked by a flag F opposite end of the lever, thereby detecting the leading end of the sheet. The lever L is biased in a clockwise direction by a spring or a gravity force to the extent that the sheet is not buckled.

B. Sensor of Reflection Type

An infrared ray is emitted toward a sheet, and reflected light or scattered light from the sheet is detected by a light receiving element. On the basis of a light amount received, presence/absence of the sheet is judged.

C. Sensor of Permeable Type

An infrared ray is emitted toward a sheet, and light passed through the sheet is received by a light receiving element. On the basis of a light amount passed, presence/absence of the sheet is detected.

In recent years, digitization has been progressed. For example, the more the number of revolutions of a polygon mirror is increased and drive frequencies of an LED head and an ink jet head are increased the more technical problems are increased, thereby increasing solution cost. Thus, in apparatuses having the same image forming speed, it has been requested that a distance between the sheets continuously conveyed be decreased to improve productivity. Further, regarding energy aspect and endurance aspect of all of parts moved or rotated, it is desirable that the image forming speed be reduced as less as possible.

However, if the distance between the sheets continuously conveyed is reduced to zero ultimately, since the leading and trailing ends of the sheet cannot be detected, control for sheet conveyance cannot be effected. For example, alignment between the sheet and an image position and detection of a jammed sheet cannot be effected.

In the lever type (A), as shown in FIG. 2B, if the trailing end of the sheet does not pass through the distal end of the fallen lever L, since the lever cannot be returned to its original position, at least a sheet-to-sheet distance (La) corresponding to a length of the lever L is required, and a time period of several tends of milliseconds is required for returning the lever L. Regarding this time period, as the sheet conveying speed is increased, loss of the sheet-to-sheet distance becomes greater; for example, when the time period for returning the lever L is 30 milliseconds and the sheet conveying speed is 500 mm/sec, the sheet-to-sheet distance of 15 mm is further required.

In the sensor of reflection type (B) and the sensor of permeable type (C), although the loss of the sheet-to-sheet distance is smaller than in the lever type, the sheet-to-sheet distance of about 5 mm is required for preventing erroneous detection.

SUMMARY OF THE INVENTION

The present invention aims to eliminate the above-mentioned conventional drawbacks, and an object of the present invention is to provide a sheet conveying apparatus in which, even when a sheet-to-sheet distance is approached to zero, the sheet can be detected.

According to the present invention, there is provided a sheet conveying apparatus comprising a sheet feeding means for separating and feeding sheets one by one, a convey guide means for guiding the sheet fed out by the sheet feeding means, a spacing means provided on the guide means and adapted to deviate positions of a trailing end of a preceding sheet and a leading end of a succeeding sheet which is fed continuously to the preceding sheet, and a sheet detecting mean for detecting the leading end of the succeeding sheet deviated from the trailing end of the preceding sheet by the spacing means.

DETAILED DESCRIPTION OF THE PREFERRED EMBODIMENTS

Figure 1:
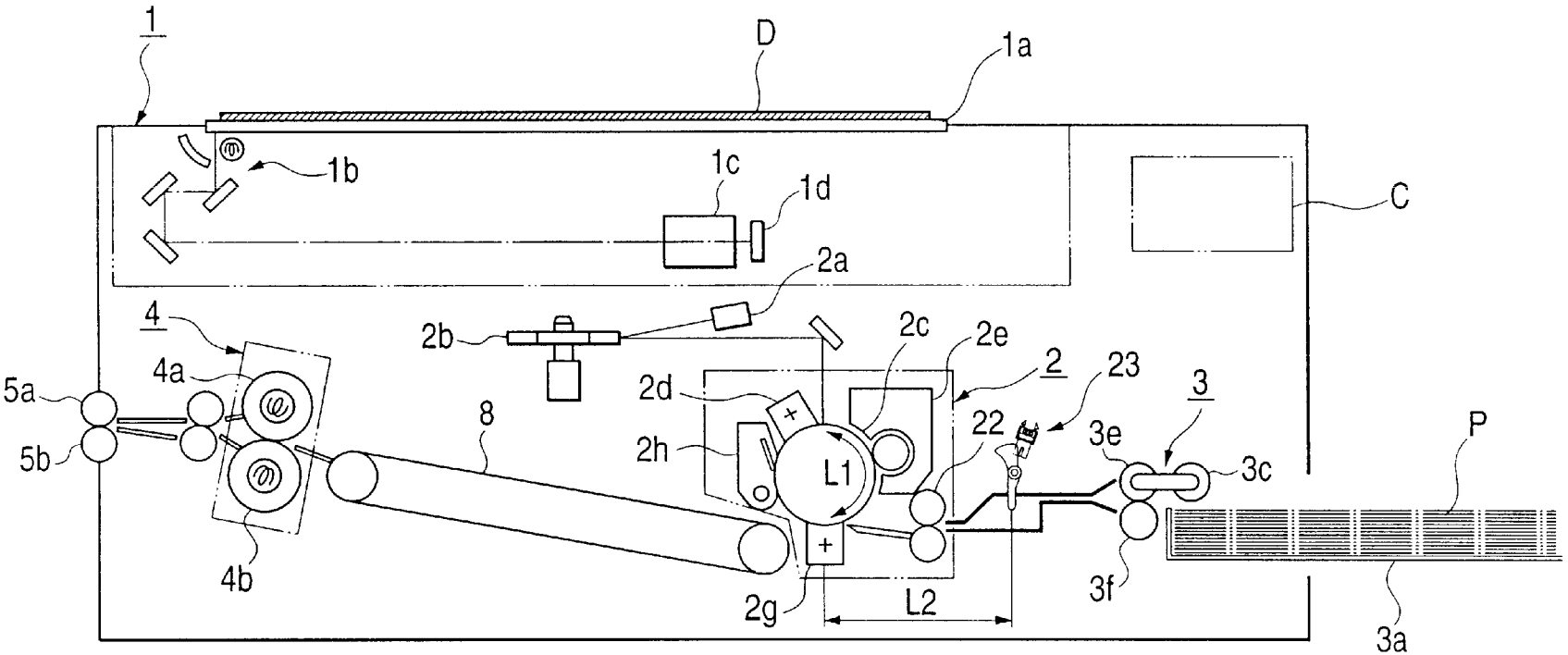
FIG. 1 is a sectional view of an image forming apparatus according to a first embodiment of the present invention.

Now, an example that a sheet conveying apparatus according to the present invention is applied to a copying machine of electrophotographic type will be explained. FIG. 1 is a sectional view showing a schematic construction of the copying machine according to a first embodiment of the present invention.

First of all, the schematic construction of the copying machine will be described with reference to FIG. 1. In the copying machine, image information read in a reader portion 1 having a scanning optical system is photo-electrically converted, and the converted data is sent to an image forming portion (image forming means) 2, an image is formed on a sheet P fed by a sheet feeding portion (sheet feeding means) 3 in the image forming portion 2. After the image formation, the sheet P is conveyed to a fixing device 4, where a transferred image is a fixed to the sheet by heat and pressure. Since a series of electrophotographic processes are well-known, detailed explanation thereof will be omitted.

Next, a construction of the reader portion 1 will be described. An original D rested on an original glass plate 1*a* is illuminated by light from a scanning optical system 1*b* having a light source and a group of mirrors, and reflected light is focused on a CCD 1*d* through a reducing glass 1*c*. Then, after the light is photo-electrically converted and A/D-converted, image information is transferred to a memory. A maximum original size is LTR size or A3 size.

A sheet feeding cassette 3*a* containing sheets P is detachably mounted to a lower part of the copying machine. In the apparatus according to the illustrated embodiment, the sheets are conveyed with a sheet-to-sheet distance of "zero". Now, an operation will be described with reference to FIGS. 2A to 2E.

Figure 2A:
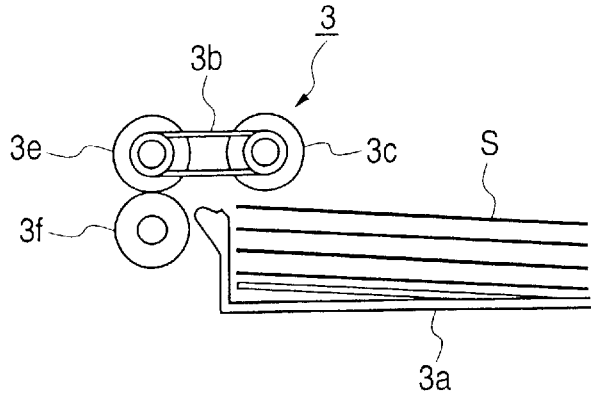
FIGS. 2A, 2B, 2C, 2D and 2E are sectional views showing a sheet detecting portion according to a first embodiment of the present invention.

Before the sheet is fed, as shown in FIG. 2A, a solenoid (not shown) connected to a pick-up roller 3*c* is turned ON to space the pick-up roller 3*c* apart from a surface of a sheet stack.

Figure 2B:
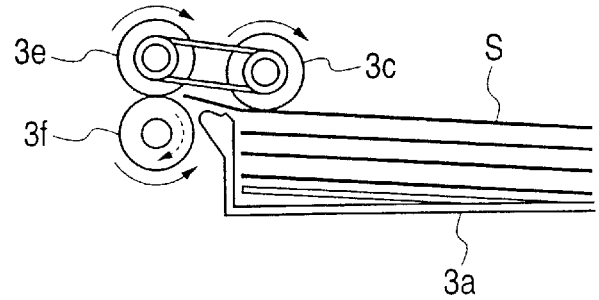

When the sheet is fed, as shown in FIG. 2B, the solenoid is turned OFF to abut the pick-up roller 3*c* against the sheet stack.

A first (preceding) sheet starts to be fed by the rotating pick-up roller 3*c*. A driving force is transmitted from a conveying roller 3e through a timing belt 3*b*.

Figure 2C:
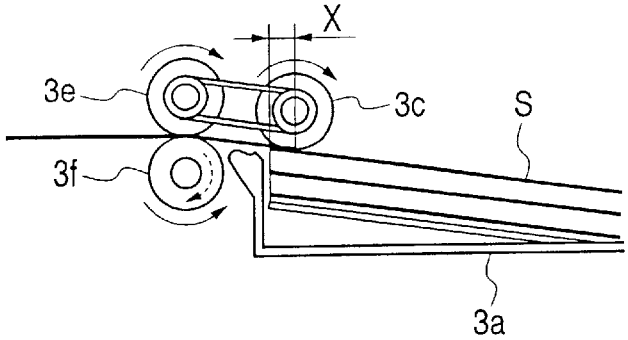

After the first sheet was fed, when a trailing end of the sheet reaches the pick-up roller 3*c*, as shown in FIG. 2C, since the pick-up roller 3*c* still abuts against the sheet stack, a second (succeeding) sheet is also fed in an overlapped condition by a distance X.

The sheet is pinched between the conveying roller 3*e* and a retard roller 3*f* and is conveyed by these rollers. The conveying roller 3*e* is rotated in a sheet conveying direction, and the retard roller 3*f* is rotatingly driven in a direction opposite to the sheet conveying direction via a torque limiter (not shown). Thus, since only a leading end portion of the first sheet exists between the rollers 3*e*, 3*f*, a friction force between the sheet and the rollers overcomes the torque limiter, with the result that the retard roller 3*f* is rotated in the sheet conveying direction.

Figure 2D:
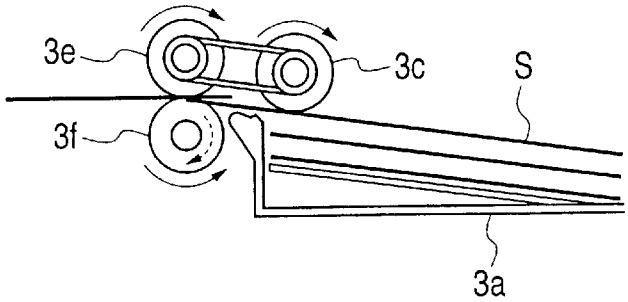

As shown in FIG. 2D, an X portion of the trailing end of the first sheet (where two sheet are overlapped) reaches the nip between the rollers 3*e*, 3*f*, since the friction force between the first and second sheets is smaller than load (limit value) for interrupting the driving of the torque limiter, the driving force is transmitted from the torque limiter to the retard roller 3*f* to rotate the retard roller 3*f* in the direction opposite to the conveying direction, with the result that only the uppermost sheet (first sheet) is separated and fed. Even if a plurality of sheets are picked up, only the uppermost sheet is separated and fed in the similar manner.

Figure 2E:
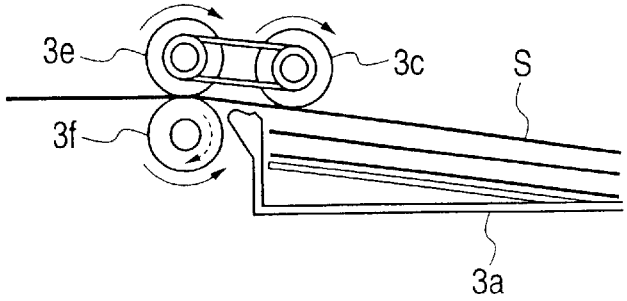

As shown in FIG. 2E, the overlapped sheets are separated, and, in a condition that the sheet-to-sheet distance is zero, the sheet are fed repeatedly for a predetermined number of sheets. After the predetermined number of sheets were fed, the driving is interrupted and the pick-up roller 3*c* is released. In this way, the sheets can be fed with the sheet-to-sheet distance of "zero".

Incidentally, other than the above-mentioned arrangement, there are many means for maintaining the sheet-to-sheet distance to zero, and, alternatively, the trailing end of the preceding sheet and the leading end of the succeeding sheet may slightly be overlapped.

Then, the leading end of the sheet fed by the sheet feeding portion 3 is temporarily stopped by a pair of registration rollers 22. Thereafter, the sheet is conveyed again in synchronous with the image formed by the image forming portion 2 to a transfer portion, where the image is transferred onto the sheet. The driving of the pair of registration rollers 22 is effected by connection of a clutch (not shown) which is controlled by a controller C in a main body of the copying machine.

In response to the image information read by the reader portion 1, a laser light emitting portion 2*a* emits a laser beam via a laser driver. The laser beam is scanned along the generatrix of a photosensitive drum 2*c* by rotation of a polygon mirror 2*b*, thereby forming a latent image on a surface of the photosensitive drum which was previously charged by a charger 2*d*. The latent image is developed by a developing unit 2*e* disposed around the photosensitive drum 2*c* to form a toner image which is in turn transferred onto the sheet P conveyed by the pair of registration rollers 22 by means of a transfer charger 2*g*. After the image transferring, residual toner remaining on the photosensitive drum is removed by a cleaning device 2*h*.

The timing for forming the latent image is controlled by the controller C in the main body on the basis of a detecting timing of a leading end detection sensor 23 for detecting the leading end of the sheet in consideration of a time period during which the sheet reaches from the sensor to the transfer point. Thus, in the illustrated embodiment, it is selected so that a distance L1 from the exposure point to the transfer point becomes smaller than a distance L2 from a sensor lever 24 of the leading end detection sensor 23 (described later) to the transfer point (L1<L2).

The sheet P to which the toner image was transferred at the image forming portion 2 is sent, by a convey belt 8, to the fixing device 4, where, while the sheet is being passed between a pair of fixing rollers 4*a*, 4*b*, the toner image is fused and fixed to the sheet P by heat and pressure.

The sheet P to which the image was fixed by the fixing device 4 is discharged out of the copying machine by a pair of discharge rollers 5*a*, 5*b*.

Next, a detecting mechanism for detecting the sheet conveyed with zero sheet-to-sheet distance, which is a characteristic portion of the present invention will be fully explained.

Since the sheets fed from the sheet feeding portion 3 have zero sheet-to-sheet distance or are partially overlapped by a predetermined amount, if the leading end of the sheet cannot be detected, alignment between the sheet and the image formed in the image forming portion 2 cannot be achieved. Further, in a case where the sheet is jammed, if the sheet jam cannot be detected, the main body of the copying machine may be damaged.

To avoid this, in the illustrated embodiment, a stepped portion (spacing means) is provided on a guide between the conveying roller 3*e* and the pair of registration rollers 22 so that the leading end of the sheet can be detected.

Figure 3A:
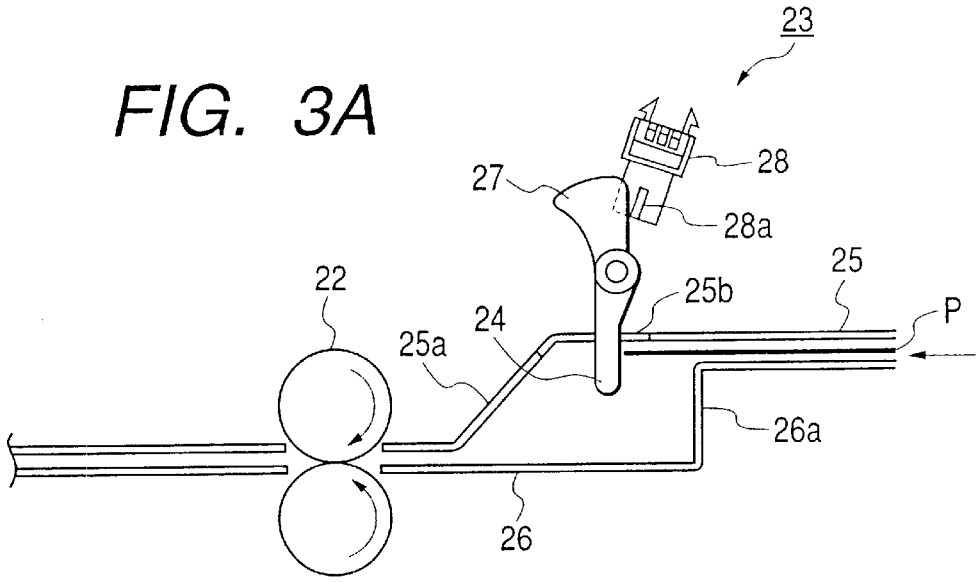
FIGS. 3A, 3B and 3C are sectional views of a sheet detecting portion according to a first embodiment of the present invention.

Such an arrangement will be described with reference to FIGS. 3A to 3C.

The guide between the conveying roller 3*e* and the pair of registration rollers 22 is constituted by an upper guide 25 and a lower guide 26 opposed to the upper guide.

The upper guide 25 has an inclined portion 25*a* inclined downwardly toward the downstream pair of registration rollers 22 so that the sheet can smoothly be guided in a nip of the pair of registration rollers 22. The lower guide 26 is provided with a stepped portion 26*a* bent at a right angle at a position upstream of he inclined portion 25*a*, so that a space is formed between the inclined portion 25*a* of the upper guide 25 and the stepped portion 26*a* of the lower guide 26.

The sensor lever 24 of the leading end detection sensor 23 is inserted into the space through an opening portion 25*b* formed in the upper guide 25. The lever can be rocked to be fallen (laid) down by the sheet P being conveyed. The leading end detection sensor 23 has the sensor lever 24, a flag 27 provided at the end of the sensor lever 24, and a photo-interrupter 28 ON/OFF-controlled by the flag 27. The leading end detection sensor 23 is disposed at a center in a width-wise direction of the sheet P.

The photo-interrupter 28 has a light emitting portion and an opposed light receiving portion. A light amount in the light receiving portion is photo-electrically converted to obtain a voltage value, and, on the basis of the voltage value, it is judged whether the flag 27 exists in a space 28*a* between the light emitting portion and the light receiving portion. Incidentally, the sensor lever 24 is biased toward a clockwise direction by a spring (not shown) to be kept in a position shown in FIG. 3A.

Next, the sheet detecting operation of the leading end detection sensor 23 will be described.

Figure 3B:
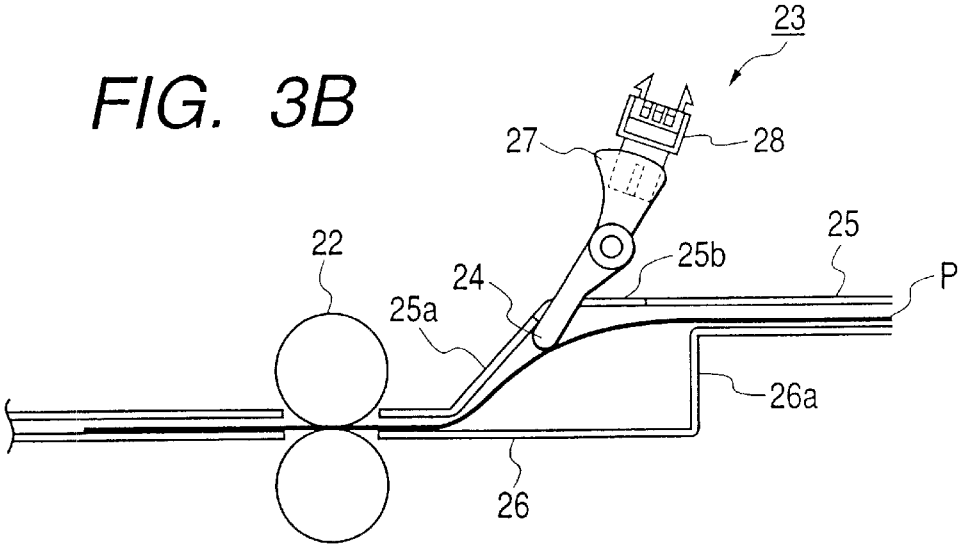
Figure 3C:
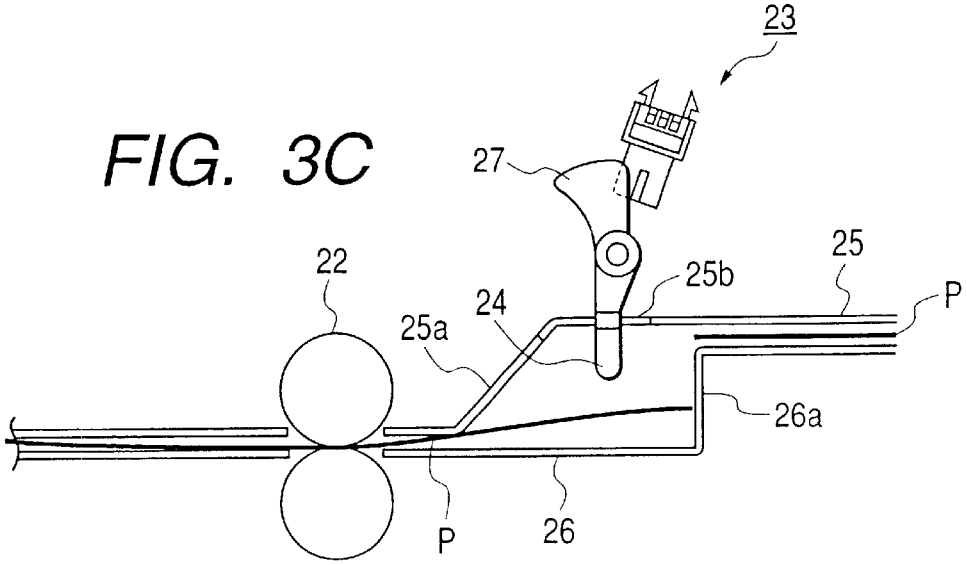

As shown in FIG. 3B, the leading end of the conveyed first sheet is directed to the pair of registration rollers 22 along the inclined portion 25*a* of the upper guide 25 by resiliency (rigidity) of the sheet itself. Meanwhile, the leading end of the sheet pushes the sensor lever 24 to rotate the lever in a clockwise direction. When the flag 27 of the sensor lever 24 enters into the space 28*a* between the light emitting portion and the light receiving portion of the photo-interrupter 28, the leading end of the sheet P is detected.

After the leading end of the first sheet P is detected by the leading end detection sensor 23, the leading end of the sheet reaches the pair of registration rollers 22 which are now stopped. The conveying roller 3*e* is rotated to further convey the sheet until a predetermined loop is formed in the sheet to correct skew-feed. Rotation of the pair of registration rollers 22 is started at a predetermined timing after a waiting condition that the sheet abuts against the nip of the pair of registration rollers, thereby sending the sheet to the image forming portion.

Then, when the trailing end of the first sheet P passes through the stepped portion 26*a* of the lower guide 26, due to the resiliency of the sheet and a gravity force, the sheet is dropped along the lower guide 26. At the same time, the sensor lever 24 is returned to its initial position by the spring and the flag 27 leaves the space 28*a* between the light emitting portion and the light receiving portion of the photo-interrupter 28, thereby preparing for detection of a leading end of a next sheet.

If the flag 27 of the sensor lever 24 is not detected by the photo-interrupter 28 after a predetermined time period is elapsed or if the flag continues to be detected, the controller C of the main body judges that the sheet jam occurs, and the copying machine is stopped.

The leading end of the second sheet P with zero sheet-to-sheet distance with respect to the first sheet is similarly detected by the leading end detection sensor 23. In this way, the sheets continuously fed with zero sheet-to-sheet distance can surely be detected.

Incidentally, rather than zero sheet-to-sheet distance, if the sheets are partially overlapped, the leading end of the sheet can be detected. That is to say, if the sheets are overlapped by an amount corresponding to a length between the stepped portion 26*a* of the lower guide 26 and the lever 24 of the leading end detection sensor 23 or less, since the first sheet is dropped after passing the stepped portion 26*a*, so long as the leading end of the second sheet is not detected by the leading end detection sensor 23 when the first sheet is dropped, the second sheet can be detected by the leading end detection sensor 23.

Figure 4:
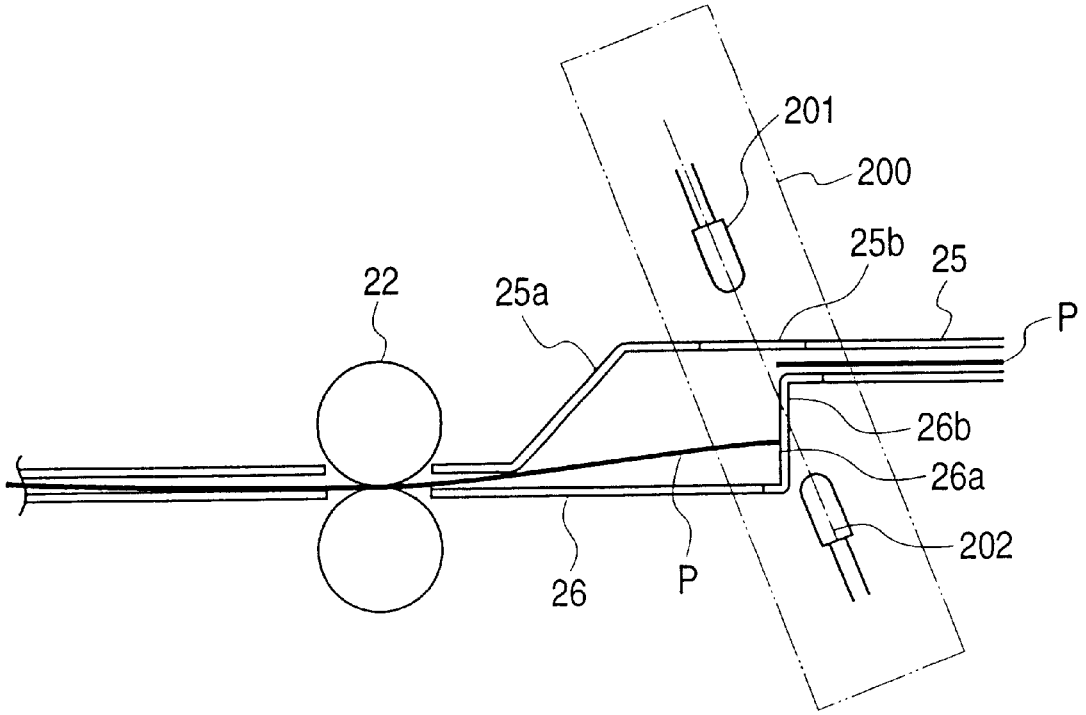
FIG. 4 is a sectional view showing another example of a sheet detecting portion.

FIG. 4 shows a sensor 200 of permeable type used in place of the leading end detection sensor 23 of lever type according to the illustrated embodiment. A light emitting portion 201 and a light receiving portion 202 are opposed to each other with the interposition of the upper guide 25 and the lower guide 26, and opening portions 25*b*, 26*b* for passing light are formed in the guides.

In the sensor 200 of permeable type, a light amount in the light receiving portion 202 is photo-electrically converted to determine a voltage value, and, on the basis of the voltage value, it is judged whether the sheet P exists between the light emitting portion 201 and the light receiving portion 202. Incidentally, since the elements designated by the same reference numerals as those in FIG. 3 have the same functions, explanation thereof will be omitted.

Figure 5:
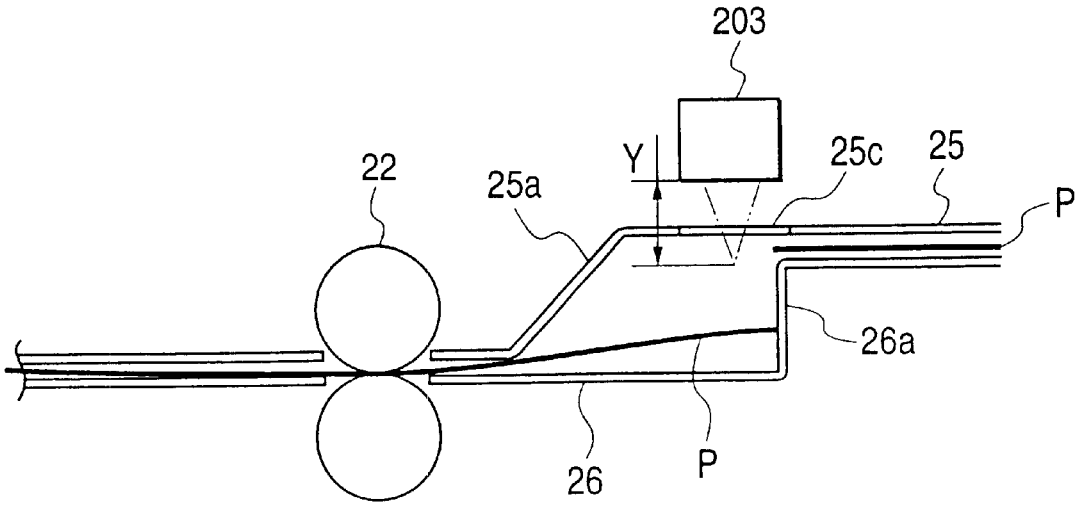
FIG. 5 is a sectional view showing a further example of a sheet detecting portion.

FIG. 5 shows an example that a sensor 203 of reflection type is used in place of the leading end detection sensor 23. The sensor 203 of reflection type is disposed above the upper guide 25. In this sensor, light from a light emitting portion is illuminated on the sheet P and, by detecting an amount of reflected light from the sheet by a light receiving portion, presence/absence of the sheet is judged. An opening portion 26*c* for passing the light is formed in the upper guide 25. A detection distance from the sensor 203 of reflection type is finite, and thus, if a distance from the sensor 203 of reflection type is too long, detection becomes impossible. In the illustrated embodiment, a detection possible range is shown by "Y", so that, when the trailing end of the sheet is positioned along the lower guide 26, it is judged that the sheet is absent.

Figure 6:
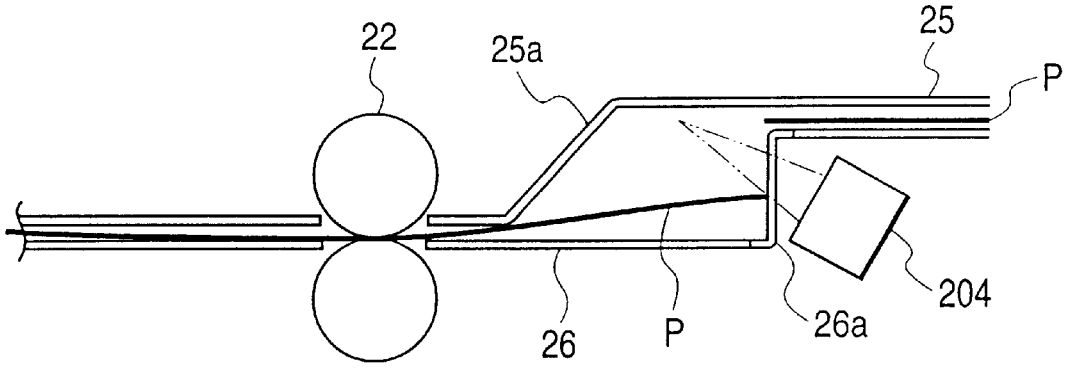
FIG. 6 is a sectional view showing a still further example of a sheet detecting portion.

FIG. 6 shows an example that a sensor 204 of reflection type is disposed below the lower guide 26. Since the other arrangements are the same as those shown in FIG. 5, explanation thereof will be omitted.

Figure 7:
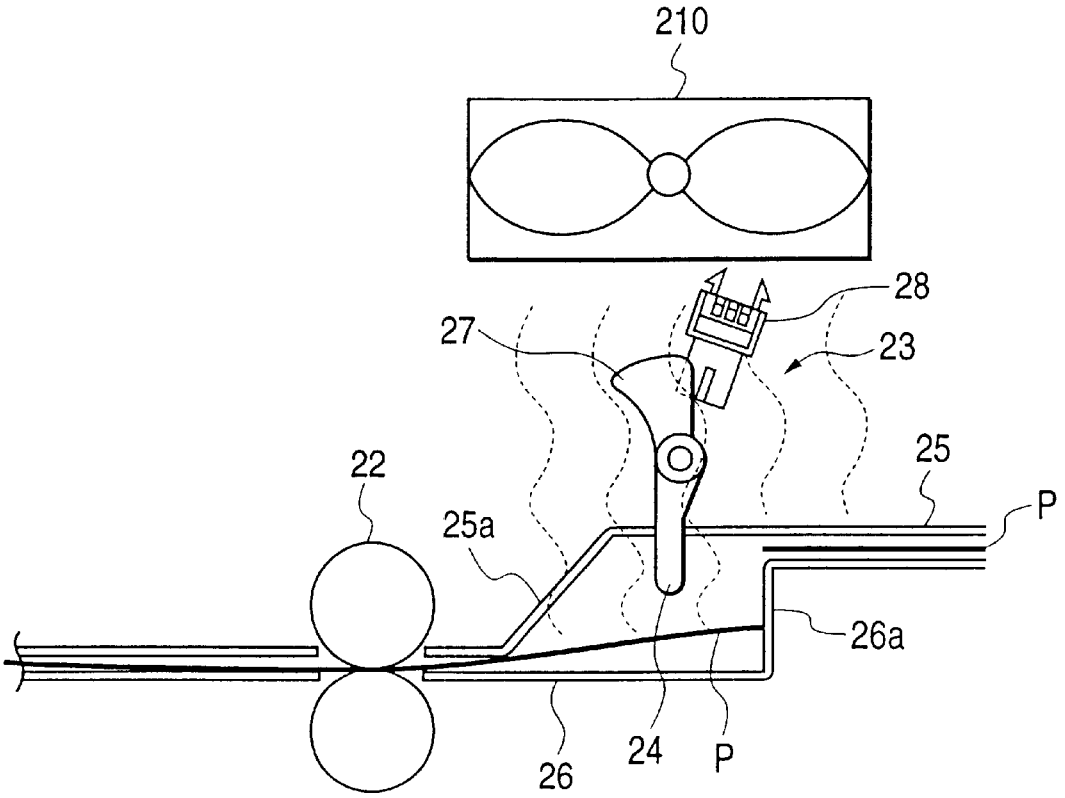
FIG. 7 is a sectional view showing an example of an auxiliary means.
Figure 8:
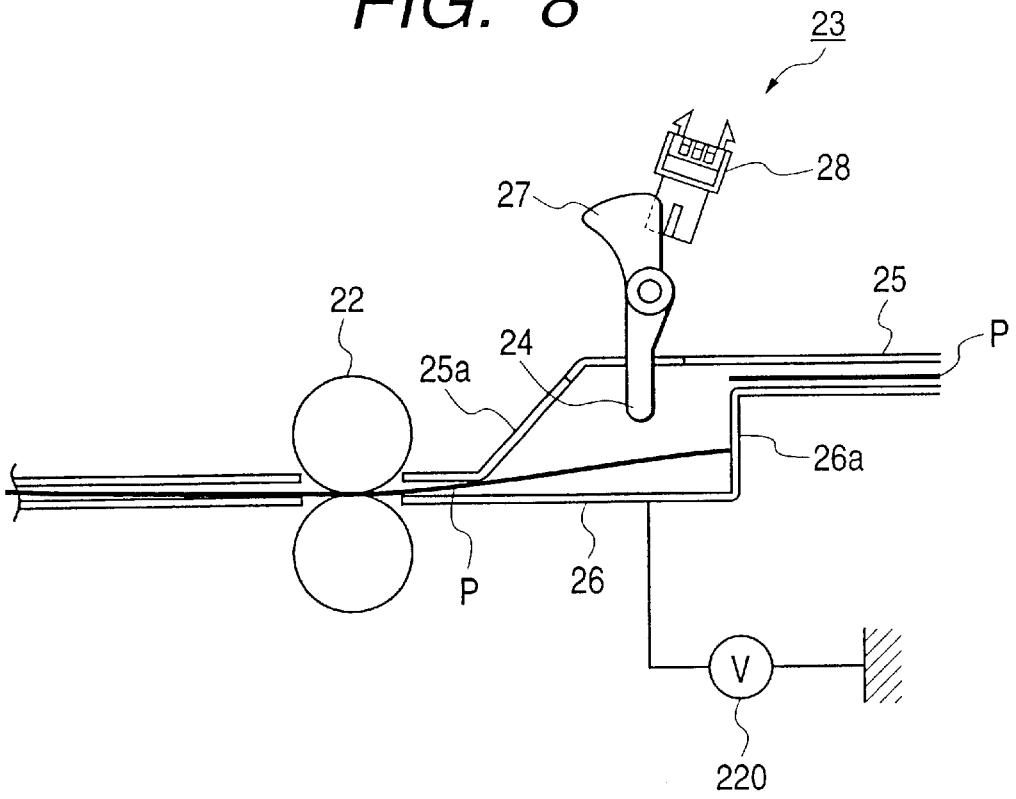
FIG. 8 is a sectional view showing another example of an auxiliary means.
Figure 9:
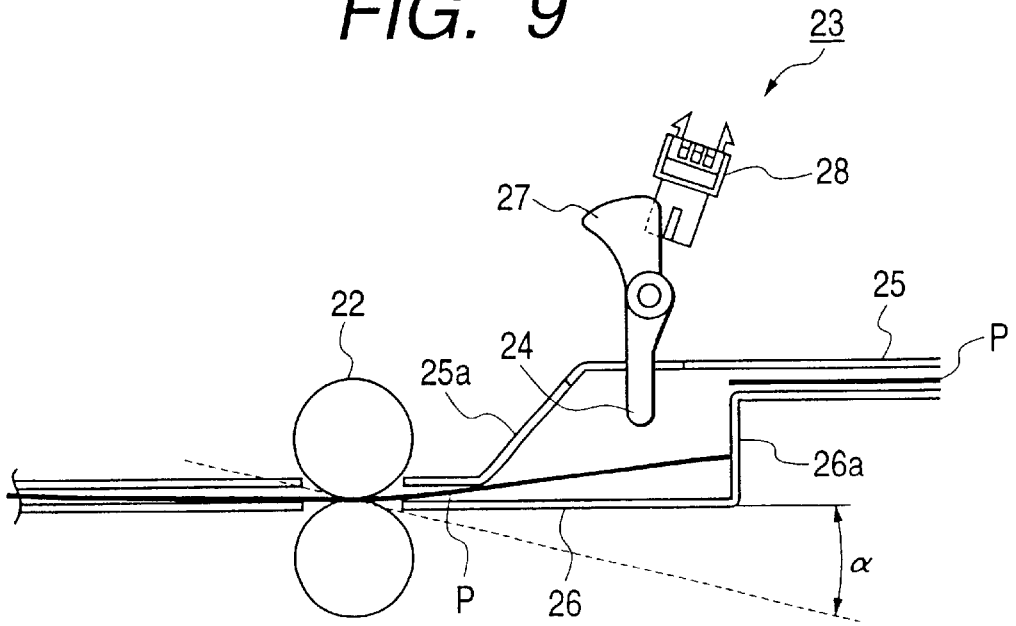
FIG. 9 is a sectional view showing a further example of an auxiliary means.

FIGS. 7 to 9 show various auxiliary means for positively dropping the trailing end of the sheet along the lower guide 26 when the trailing end of the sheet passes through the stepped portion 26*a* of the lower guide 26.

In the auxiliary means shown in FIG. 7, in order to positively drop the trailing end of the sheet along the lower guide 26 even if the sheet is curled, air blow is applied from a fan 210 disposed above the upper guide 25. An opening portion (not shown) for passing the air blow is formed in the upper guide 25. Incidentally, a suction fan 210 may be arranged below the lower guide 26 to such the sheet, thereby positively drawing the trailing end of the sheet toward the lower guide 26. Since the other arrangements are the same as those described above, explanation thereof will be omitted.

In the auxiliary means shown in FIG. 8, voltage is applied from a power supply 220 to the lower guide 26 to charge the lower guide, thereby positively drawing the sheet toward the lower guide 26. Since the other arrangements are the same as those described above, explanation thereof will be omitted.

In the auxiliary means shown in FIG. 9, by inclining a tangential angle of the nip of the pair of registration rollers 22 by an angle a with respect to the horizontal direction, the trailing end of the sheet P is positively dropped toward the lower guide 26 by the resiliency of the sheet itself. According to this arrangement, since installation of the pair of registration rollers 22 may merely be adjusted, the construction can be simplified not to make the machine expensive. Since the other arrangements are the same as those described above, explanation thereof will be omitted.

Incidentally, in the above-mentioned embodiment, while an example that the leading end of the sheet conveyed with zero sheet-to-sheet distance is detected was explained, even when the trailing end of the preceding sheet and the leading end of the succeeding sheet is slightly overlapped, the leading end of the sheet being conveyed can be detected by such an embodiment. In this case, the sheet are conveyed in such a manner that the preceding sheet is positioned under the succeeding sheet, and the overlapped amount may be selected to become smaller than a distance between a start point of the stepped portion 26*a* of the lower guide and the lever 24 of the leading end detection sensor 23.

Further, in the above-mentioned embodiment, while an example that the present invention is applied to a position where the sheet is guided by the upper and lower guides in order to convey the sheet substantially along the horizontal direction was explained, the present invention may be applied to guides for conveying the sheet along a vertical direction.

Next, a second embodiment of the present invention will be explained with reference to the accompanying drawings.

Figure 10:
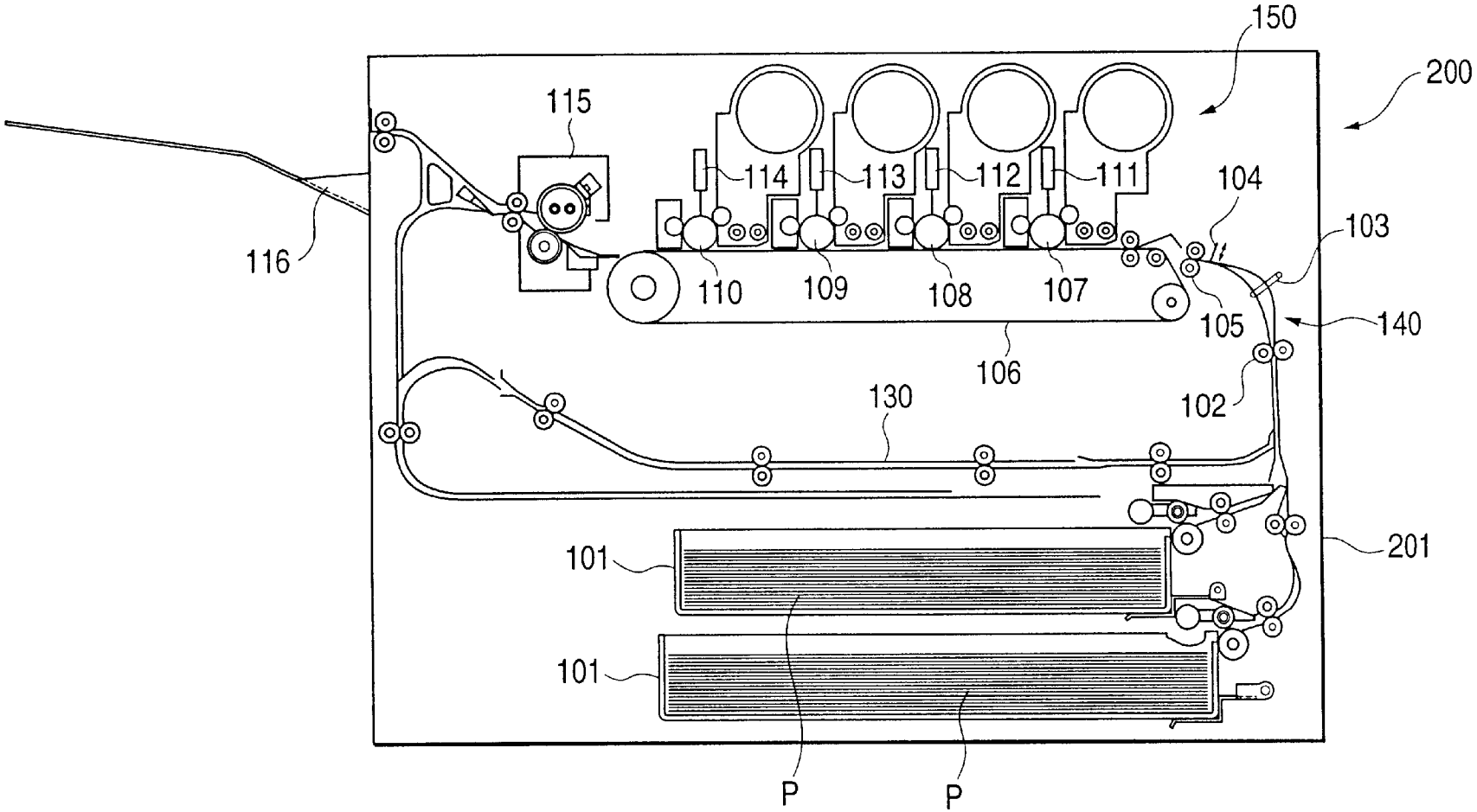
FIG. 10 is a view showing a construction of an image forming apparatus according to a second embodiment of the present invention.

FIG. 10 shows a construction of an image forming apparatus according to a second embodiment of the present invention. In FIG. 10, the reference numeral 200 denotes an image forming apparatus, and 201 denotes to a main body of the image forming apparatus (referred to merely as "main body" hereinafter).

In the image forming apparatus 200, after a sheet P on which an image is to be formed is fed from a sheet feeding cassette (sheet containing means) 101, the sheet is passed through a convey path 140 by a pair of longitudinal path rollers (first conveying means) 102 and a pair of post-registration rollers (second conveying mean) 105, and, thereafter, the sheet is rested on a convey belt 106 to be conveyed to an image forming portion 150.

Further, according to this image forming apparatus 200, in the image forming portion 150, toner images formed on electrophotographic photosensitive drums (four image forming means) 107, 108, 109, 110 in response to image information signals sent from a reader scanner or a personal computer (not shown) are successively transferred onto the sheet P, and then the toner images are permanently fixed to the sheet by a fixing device 115. Thereafter, the sheet on which the monochromatic image or full-color image was formed is discharged onto a discharge tray 16.

In FIG. 10, LEDs (light emitting diodes) 111, 112, 113, 114 acts as light source devices for forming the toner images on the photosensitive drums 107, 108, 109, 110 and are controlled independently. The LEDs 111, 112, 113, 114 are opposed to surfaces of the respective photosensitive drums 107, 108, 109, 110.

On the other hand, the image forming apparatus 200 has an automatic both-face function. Thus, when the images are formed on both surfaces of the sheet P, after the sheet P having one surface on which the image was formed is turned over (surface reversal) by a both-face path portion 130 of the main body 201, the sheet P is again conveyed to the image forming portion 150, where the image is formed on the other surface of the sheet.

By the way, in this image forming apparatus 200, in order to utilize a process speed of the image forming portion 150 to the maximum extent, in a continuous recording mode, the sheets P are rested on the convey belt 106 in such a manner that the sheet-to-sheet distance becomes zero, and more preferably, in such a manner that the sheets are slightly overlapped.

Next, detection of a leading end of the sheet when the sheets are conveyed in the overlapped condition will be explained with reference to FIG. 11 which is an schematic enlarged view showing the convey path 140.

Figure 11:
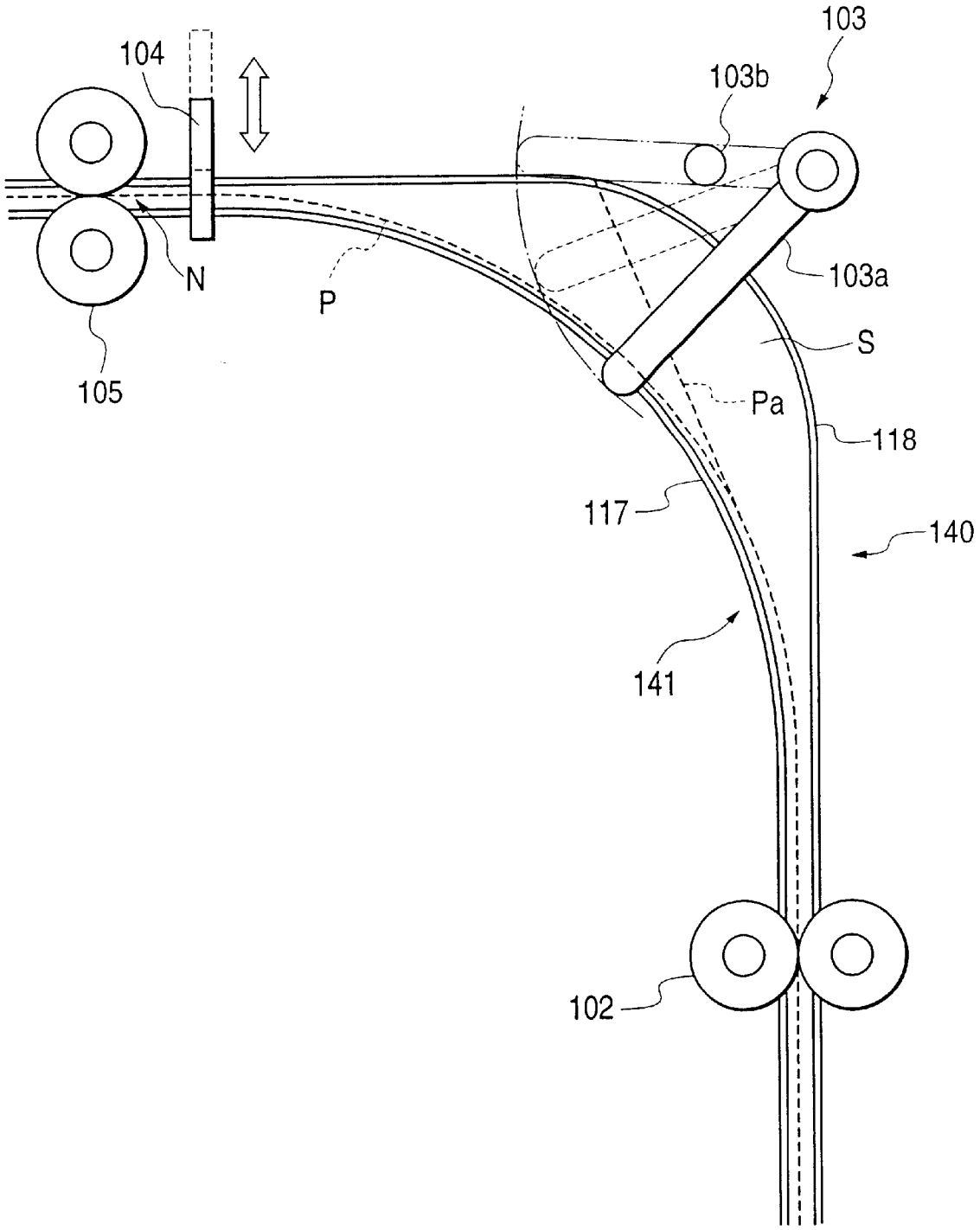
FIG. 11 is a schematic enlarged view of a convey path for conveying a sheet to an image forming portion of the image forming apparatus.

In FIG. 11, the reference numeral 117 denotes a lower guide; and 118 denotes an upper guide cooperating with the lower guide 117 to form the convey path 140 therebetween. Incidentally, the upper and lower guides 118, 117, the pair of longitudinal path rollers 102 and the pair of post-registration rollers 105 constitutes a spacing means for temporarily spacing the leading end of the succeeding sheet P overlapped with the preceding sheet P apart from the trailing end of the preceding sheet P in the convey path.

A registration member (skew-feeding correction member) 104 can be entered into or retarded from the convey path 140. When the sheet P is conveyed, the registration member 104 enters into the convey path 140, and, by abutting the leading end of the sheet P sent from the pair of longitudinal path rollers 102 against the registration member 104, registration of the sheet P is effected.

Such registration is effected by forming a loop in the sheet P after the leading end of the sheet P abuts against the registration member 104. To this end, the upper guide 118 are swollen upwardly to be separated from the lower guide 117 thereby to permit formation of the loop in the sheet P, thereby providing a loop forming space S.

On the other hand, after the registration is effected, when the registration member 104 is retarded from the convey path 140 at a predetermined timing, the sheet P elastically enters into a nip of the pair of post-registration rollers 105. When the pair of post-registration rollers 105 are rotated, the sheet is conveyed to the image forming portion 150 in the condition that the skew-feeding is corrected.

Incidentally, a length of the sheet P in the conveying direction is longer than a distance between the pair of longitudinal path rollers 102 and the pair of post-registration rollers 105, so that the sheet P is conveyed by the pair of longitudinal path rollers 102 and the pair of post-registration rollers 105 until the trailing end of the sheet P leaves the pair of longitudinal path rollers 102.

By the way, in the illustrated embodiment, when it is assumed that sheet conveying speed of the pair of longitudinal path rollers 102 is V1 and a sheet conveying speed of the pair of post-registration rollers 105 is V2, the conveying speeds V1, V2 are selected to satisfy the following relationship:

$$V1 \leqq V2 \quad (1)$$

By selecting the conveying speeds V1, V2 to satisfy the above relationship, after the registration is effected, while the sheet is being conveyed by the pair of longitudinal path rollers 102 and the pair of post-registration rollers 105, slack is not formed in the sheet P within the loop forming space S. In other words, the loop formed in the sheet P for registration can be removed during the conveyance after registration.

On the other hand, in FIG. 11, a leading end detection sensor (leading end detecting means) 103 comprises a sensor arm 103*a* rotatably provided within the loop forming space S, and a photo-interrupter 103*b*. The sensor arm 103*a* is pushed by the leading end of the sheet P conveyed by the pair of longitudinal path rollers 102 to be rotated. When the sensor arm 103*a* is rotated in this way to reach a position shown by the two dot and chain line in FIG. 11, the photo-interrupter 103*b* is turned ON.

Figure 12:
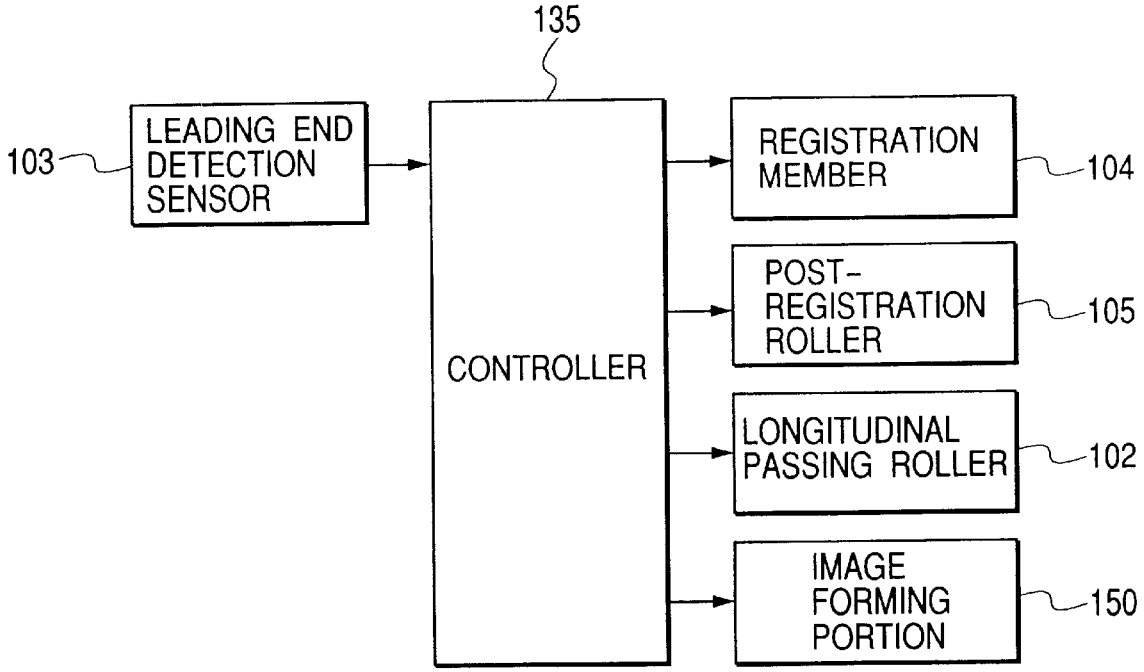
FIG. 12 is a control block diagram of the image forming apparatus.

FIG. 12 shows a control block diagram of the image forming apparatus. On the basis of an ON signal of the photo-interrupter 103*b* of the leading end detection sensor 103, a controller 135 shown in FIG. 12 detects the fact that the leading end of the sheet P has passed. Further, in response to the leading end detection, the controller 135 retards the registration member 104 from the convey path 140 at a predetermined timing after registration and drives the pair of longitudinal path rollers 102 and the pair of post-registration rollers 105 at the conveying speeds satisfying the above relationship (1).

Incidentally, when the sensor arm 103*a* is pushed by the leading end of the sheet P, the sensor arm can be retarded sufficiently not to obstruct the conveyance of the sheet P, and, when the pressure of the sheet P is released, the sensor arm can returned to an original condition by itself.

Figure 13:
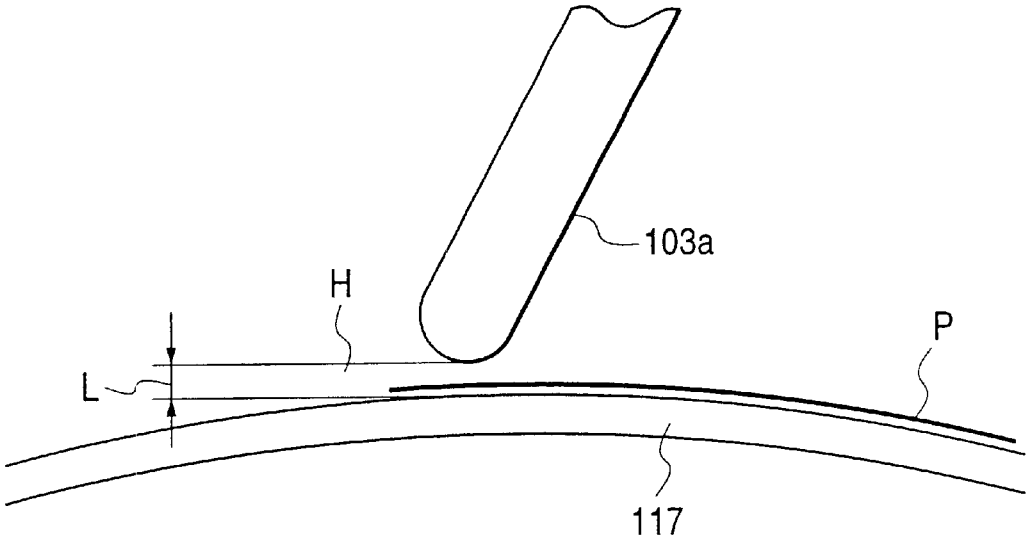
FIG. 13 is a view for explaining a non-detection area of a leading end detection sensor of the image forming apparatus.
Figure 14:
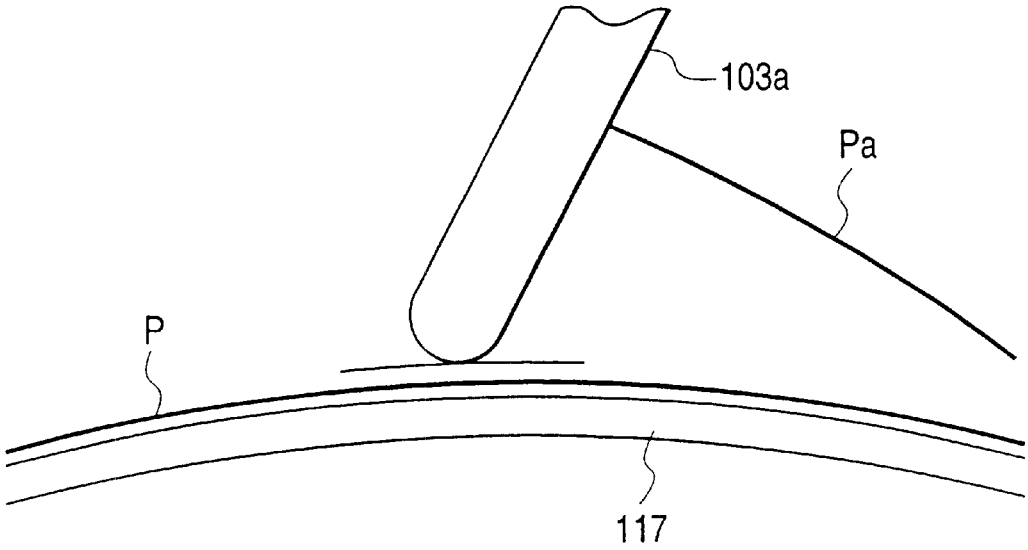
FIG. 14 is a view for explaining a leading end detection condition of the leading end detection sensor.

By the way, when the sheet P is conveyed in a condition that the sheet is pinched between the sensor arm 103*a* and the lower guide 117, the leading end detection sensor 103 does not detect the sheet P. That is to say, as shown in FIG. 13, the sheet P from which the loop is removed is shifted along the lower guide 117, and, when a distance L between the sensor arm 103*a* and the lower guide 117 becomes smaller than <(thickness of single sheet)+(predetermined small amount)>, the photo-interrupter 103*b* is turned OFF.

Namely, in this leading end detection sensor 103, when the sensor arm 103*a* is temporarily pushed by the leading end of the sheet P to be shifted to the position shown by the two dot and chain line in FIG. 11, a leading end detection signal for the sheet P can be outputted, and, when the sheet P from which the loop is removed is shifted along the lower guide 117 and the sensor arm 103*a* is rocked downwardly to a position shown by the broken line, output of the leading end detection signal is stopped.

Incidentally, an area where the output of the leading end detection signal is stopped by the leading end detection sensor 103, i.e., an area where the sheet P is not detected by the leading end detection sensor 103 is sown by "H" in FIG. 13 and is referred to as "non-detection area" hereinafter.

With this arrangement, on the basis of the leading end detection signal from the leading end detection sensor 103, the controller 135 can detect only passing of the leading end of the sheet P. Incidentally, the controller 135 controls the image forming portion 150 to effect the image forming operations successively on the basis of an OFF signal after the ON signal from the photo-interrupter 103*b*.

On the other hand, when the trailing end of the sheet P conveyed by the pair of post-registration rollers 105 reaches a curved portion 141 of the convey path 140, the leading end of the succeeding sheet Pa (referred to as "next sheet P" hereinafter) entered into the conveying path 140 in the condition that the next sheet P is overlapped with the preceding sheet P is separated from the trailing end of the sheet P, and, ultimately urges the sensor arm 103*a* abutting against the sheet P.

As a result, the sensor arm 103*a* is rocked upwardly again. As the sensor arm 103*a* is rocked upwardly, the photo-interrupter 103*b* is turned ON, and the controller 135 detects the leading end of the next sheet Pa accordingly.

Next, the leading end detecting operation of the image forming apparatus having the above-mentioned leading end detection sensor 103 will be explained.

When the continuous recording mode (image formation) is selected and start command is emitted, the controller 135 feeds the sheet P from the sheet feeding cassette 101. When the sheet is fed, the next sheet P2 is picked up before the first sheet P1 is completely removed from the sheet feeding cassette 101 so that two sheets P1, P2 are partially overlapped.

Incidentally, regarding all of the sheets to be fed, the same overlapping is performed. Preferably, the overlapped among is selected so that, after the registration is effected by the pair of post-registration rollers 105 in front of the image forming portion 150, the sheets are rested on the convey belt 106 of the image forming portion 150 in such a manner that the sheet-to-sheet distance becomes zero or the sheets are overlapped only at their margins (non-image formed areas).

Figure 15A:
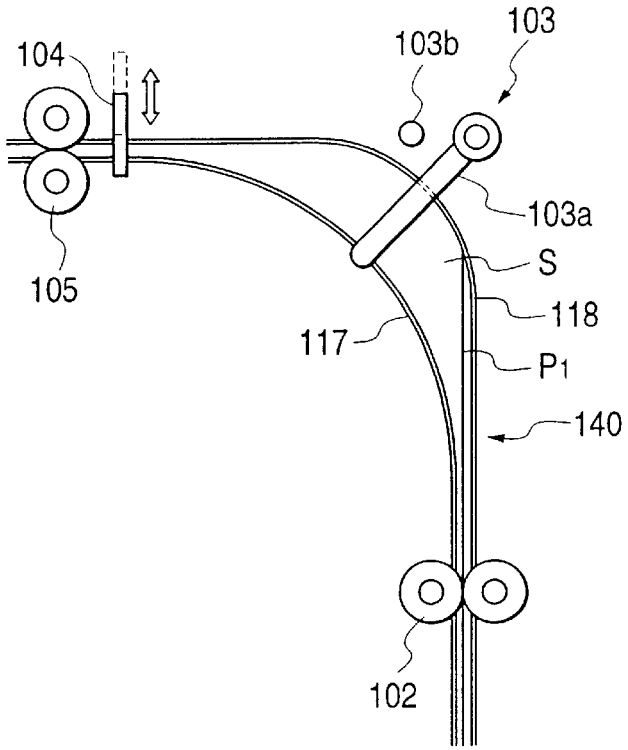
FIGS. 15A and 15B are views for explaining a leading end detecting operation of the image forming apparatus.

Then, the leading end of the first sheet P1 fed in the overlapped condition enters into the convey path 140 and, as shown in FIG. 15A, passes along the upper guide 118. Namely, the leading end of the first sheet P1 passes above the non-detection area H (FIG. 13) of the leading end detection sensor 103.

Figure 15B:
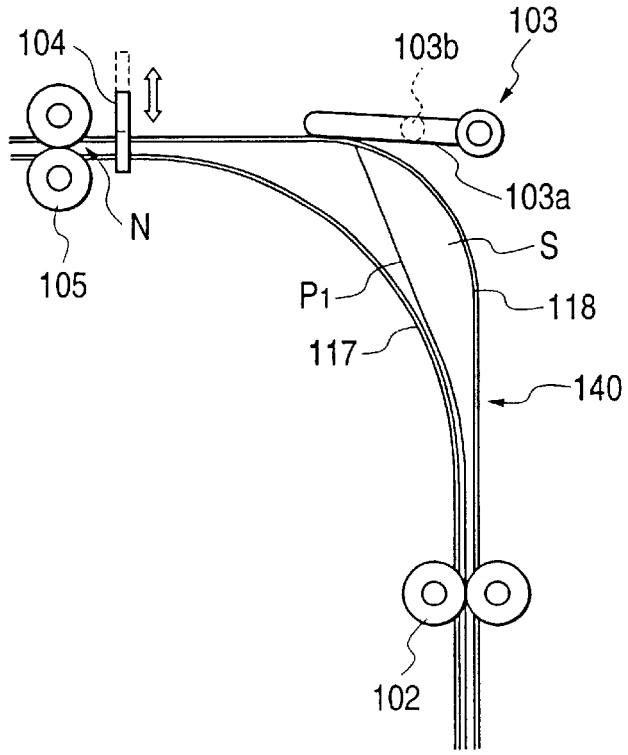

Then, the sheet P1 advances along the upper guide 118 and then pushes the sensor arm 103*a*. As a result, as shown in FIG. 15B, when the sensor arm 103*a* is rocked, the interrupter 103*b* is turned ON accordingly, and, on the basis of the ON signal from the photo-interrupter 103*b*, the controller 135 detects the leading end of the sheet P1 and effects the aforementioned registration on the basis of the detection timing.

On the other hand, after the registration is finished, the pair of longitudinal path rollers 102 and the pair of post-registration rollers 105 are driven. Incidentally, when the sheet P1 is conveyed by these rollers 102, 105, the sheet is conveyed at such a conveying speed that the slack in the first sheet P1 is removed before the second sheet P2 conveyed in the overlapped condition reaches the vicinity of the leading end detection sensor. Since this is selected on the basis of the above-mentioned relationship 1 detailed explanation thereof will be omitted.

Figure 16A:
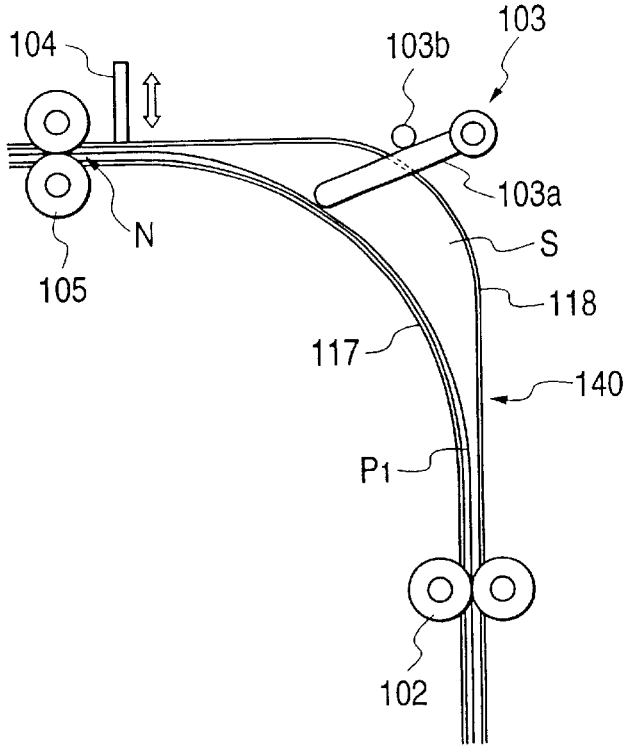
FIGS. 16A and 16B are views for explaining a leading end detecting operation of the image forming apparatus.

When the slack is removed from the first sheet P1 in this way, as shown in FIG. 16A, the first sheet P1 is conveyed along the lower guide 117, i.e., along the non-detection area, and, the sensor arm 103*a* is rocked downwardly, with the result that the leading end detection sensor 103 emits the OFF signal to the controller 135. Incidentally, when the OFF signal is outputted from the leading end detection sensor 103, the controller 135 start to drive the image forming portion 150 to form the image on the sheet P1.

Figure 16B:
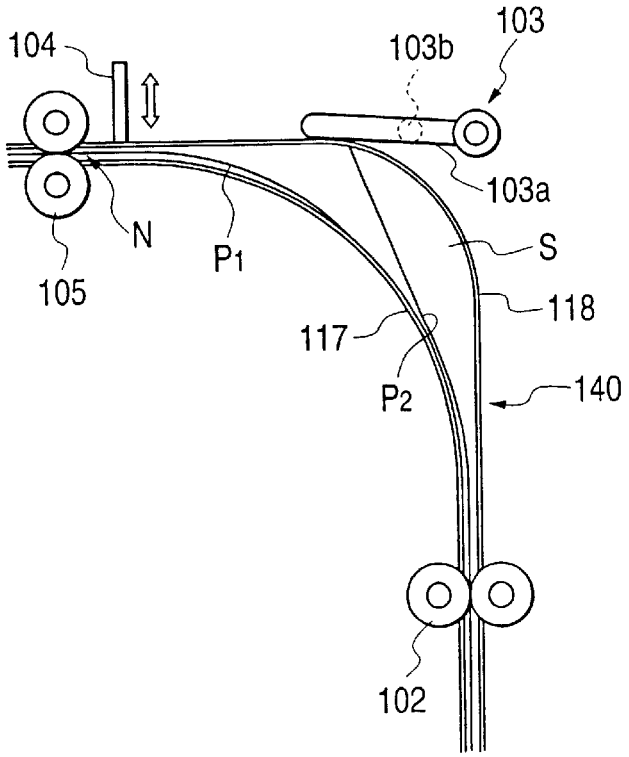

Then, when the first sheet P1 is further conveyed, the second sheet P2 enters into the convey path 140. The sheet P2 is conveyed along the upper guide 118. When the sensor arm 103*a* is pushed by the leading end of the sheet P2, the sensor arm 103*a* is rocked as shown in FIG. 16B. In this way, the controller 135 detects the leading end of the second sheet P2.

Namely, the first sheet P1 (except for the leading end thereof) is passed without being detected by the photo-interrupter 103*b*, and the leading end detection sensor 103 detects the leading end of the second sheet P2. On the basis of the detection timing, the controller 135 effects the registration and image formation for the second sheet P2. Incidentally, regarding a third sheet and so on, a leading end is detected by repeating the above operation.

In this way, after the preceding sheet P2 entered into the convey path 140 is conveyed along the upper guide 118, the sheet is shifted along the lower guide 117, and the leading end of the next sheet P2 conveyed in the overlapped relationship to the preceding sheet P1 is temporarily spaced apart from the trailing end of the preceding sheet P1. In this way, the leading end of the next sheet P2 can be detected positively.

By positively detecting the leading end of the next sheet P2 in this way, even when the sheets are conveyed in the manner that the sheet-to-sheet distance becomes zero or the sheets are slightly overlapped, the skew-feeding can be corrected and the leading margin can be maintained, thereby achieving the proper image formation.

Figure 17:
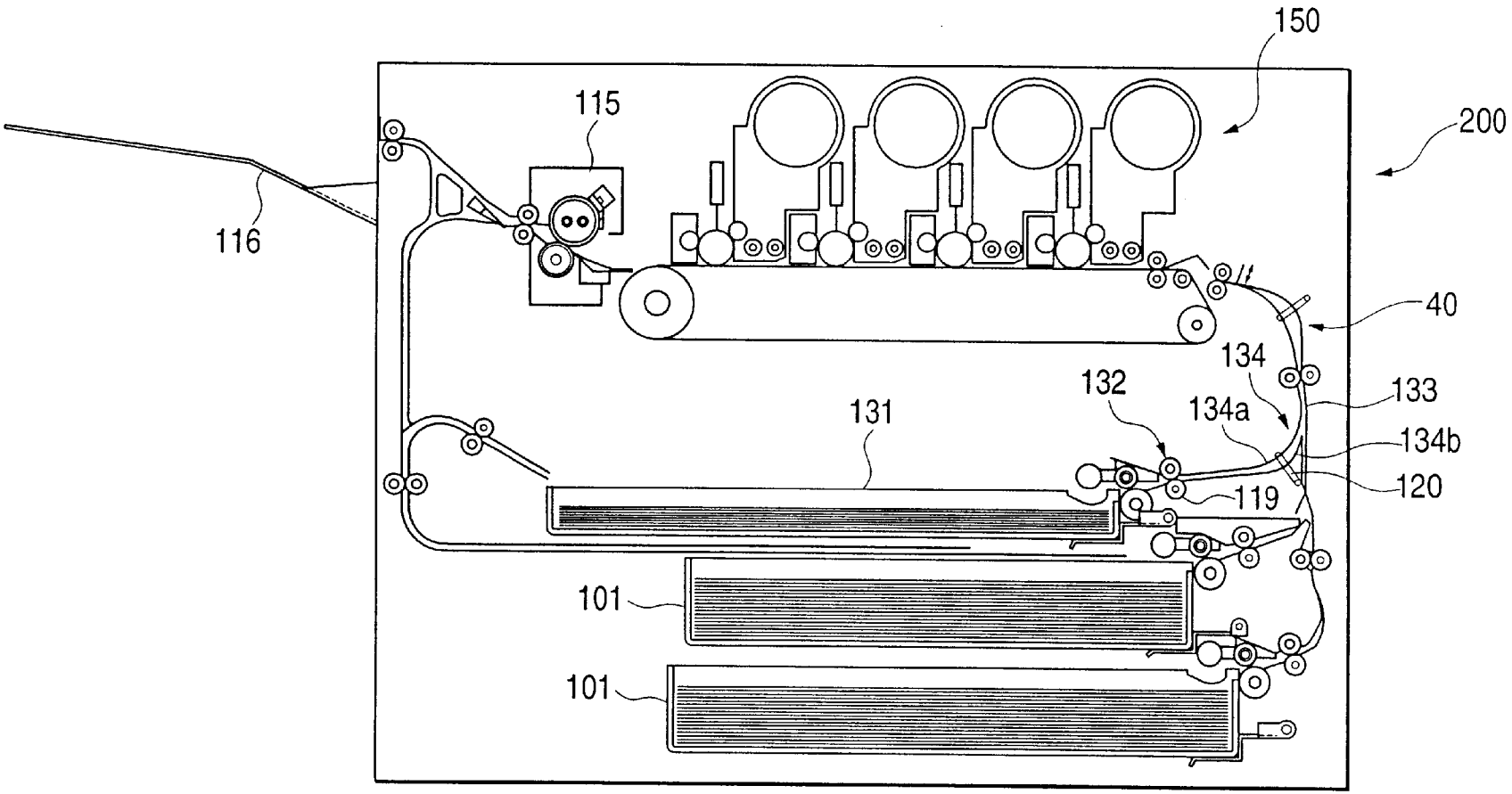
FIG. 17 is a view showing another construction of the image forming apparatus.

In the above explanation, while an example that the leading end of the sheet P is detected within the loop forming space S of the convey path 140 for effecting the registration was explained, the present invention is not limited to such an example. For example, in an image forming apparatus 200 having an intermediate tray 131 as shown in FIG. 17, a sheet path portion 134 provided at a junction between a sheet re-feeding portion 132 and a sheet feeding longitudinal path 133 and adapted to change a conveying direction may be constituted by guides 134*a*, 134*b* having different curvatures, and a leading end detection sensor 120 having the same construction as the leading end detection sensor 1 may be arranged there to detect the leading end of the sheet P in the same manner as mentioned above. As well as the image forming apparatuses, the present invention can widely be applied to apparatuses having a means for conveying a sheet P such as an applicator.

By the way, according to the aforementioned first embodiment, in the convey path 140 for changing the conveying direction, by deviating the leading end of the next sheet P from the preceding sheet P toward the leading end detection sensor, the detection of the leading end of the sheet P is made possible.

However, in consideration of various image forming apparatuses, in some cases, it is required that the leading end of the sheet be detected within a straight convey path such as a horizontal sheet path portion or a vertical sheet path portion.

Now, an image forming apparatus according to a third embodiment of the present invention to cope with such cases will be explained.

Figure 18:
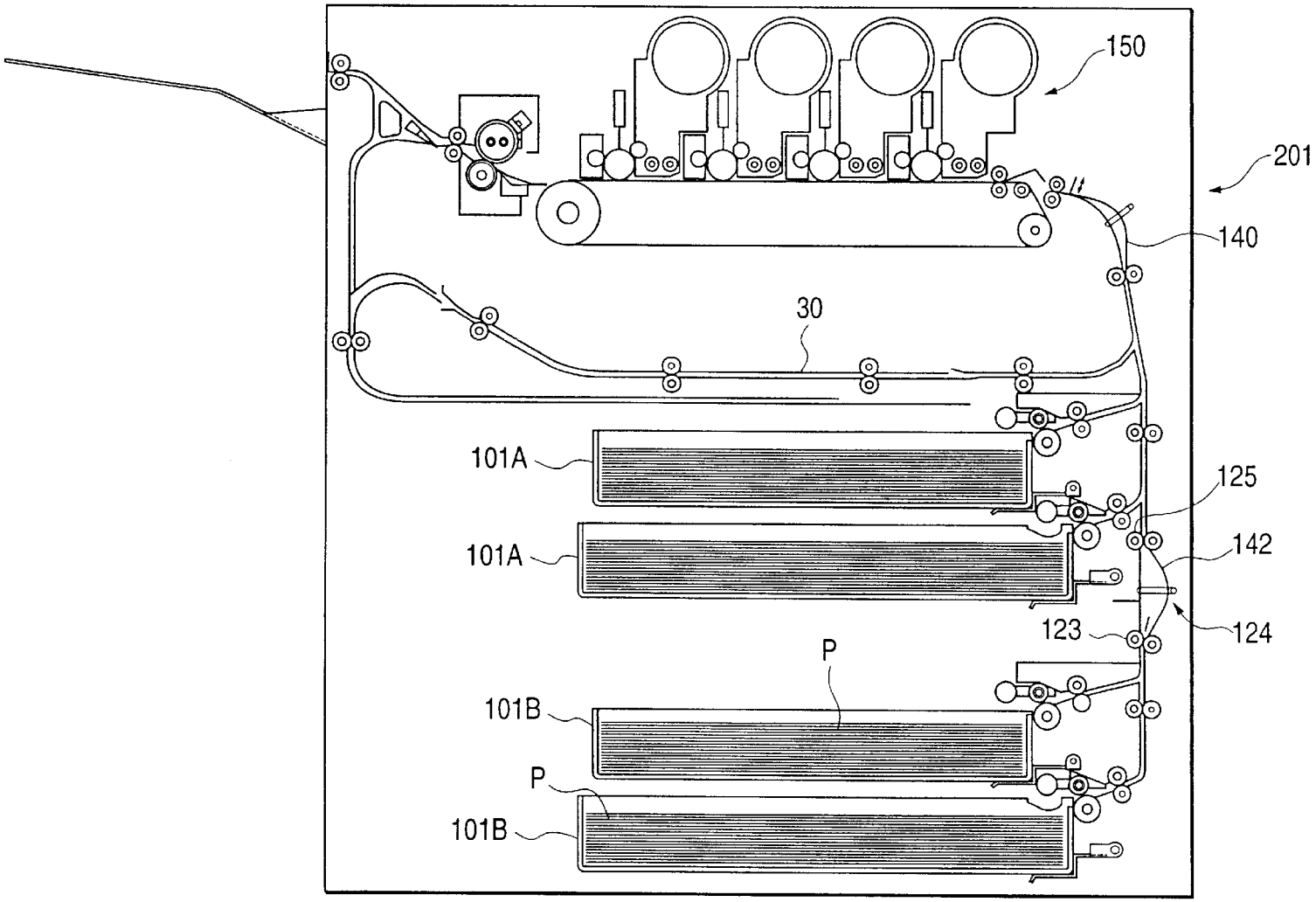
FIG. 18 is a view showing a construction of an image forming apparatus according to a third embodiment of the present invention.

FIG. 18 is a view of a construction of an image forming apparatus according to a third embodiment of the present invention. Incidentally, in FIG. 18, the same reference numerals as those in FIG. 10 designate the same elements.

In FIG. 18, a lower sheet feeding cassette 101B is disposed below an upper sheet feeding cassette 101A, a longitudinal path portion 142 serves to direct a sheet P from the lower sheet feeding cassette 101B toward a convey path 140. An upstream side conveying roller (first conveying means) 123 serves to convey the sheet P from the lower sheet feeding cassette 101B to the longitudinal path portion 142. A downstream side conveying roller (second conveying means) 125 serves to direct the sheet conveyed to the longitudinal path portion 142 toward an image forming portion 150 through the convey path 140.

Figure 19:
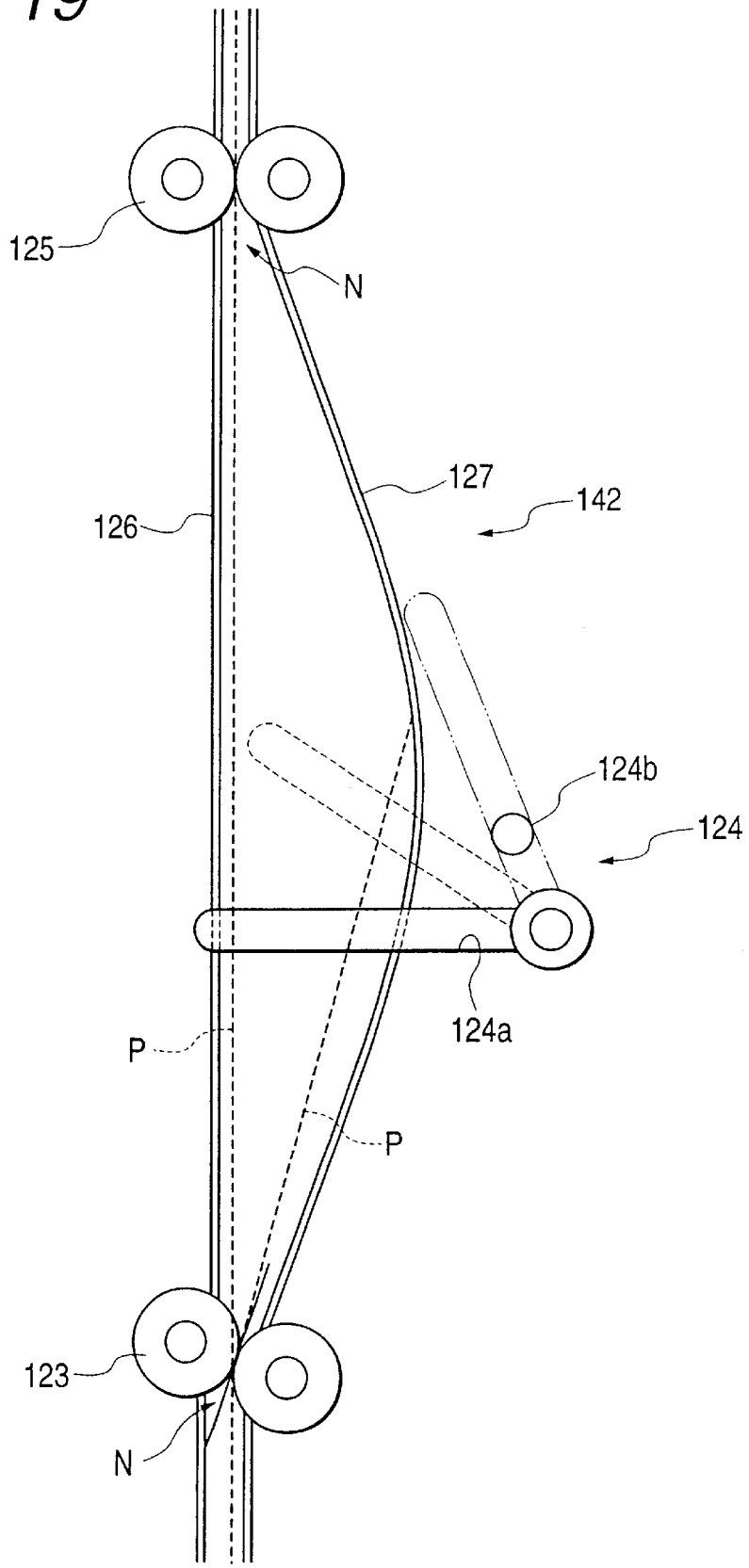
FIG. 19 is a schematic enlarged view of a longitudinal path portion of the image forming apparatus.

The longitudinal path portion 142 is substantially straight not to change the conveying direction of the sheet P; whereas the convey path 140 is curved to change the conveying direction of the sheet P. That is to say, as shown in FIG. 19, the longitudinal path portion 142 is constituted by an inner guide 126 extending substantially straightly toward the convey path 140, and an outer guide 127 having a swollen portion swollen outwardly.

Further, in the illustrated embodiment, a direction of a nip N of the downstream side conveying roller 125 is substantially in parallel with the inner guide 126 (parallel with the conveying direction; whereas, a nip N of the upstream side conveying roller 123 is directed toward the swollen portion of the outer guide 127. With this arrangement, the sheet P from the lower sheet feeding cassette 101B entered into the longitudinal path portion 142 by the upstream side conveying roller 123 is directed toward the downstream side conveying roller 125 along the outer guide 127.

Further, the outer guide 127 is provided with a leading end detection sensor 124 comprising a sensor arm 124*a* and a photo-interrupter 124*b*. Similar to the leading end detection sensor of the first embodiment, the leading end detection sensor 124 is constituted so that, when the sheet P passes through the non-detection area between the sensor arm 124*a* and the inner guide 126, the sheet P is not detected.

Incidentally, in this embodiment, when it is assumed that a conveying speed of the upstream side conveying roller 123 is V3 and a conveying speed of the downstream side conveying roller 125 is V4, the conveying speeds V3, V4 are selected to satisfy the following relationship:

$$V3<V4 \quad (2)$$

By selecting the conveying speeds V3, V4 to satisfy such a relationship, even in the longitudinal path portion 142, slack is not formed in the sheet P as less as possible.

Next, the leading end detecting operation of the image forming apparatus having the above-mentioned leading end detection sensor 124 will be explained.

When the continuous recording mode (image formation) is selected and start command is emitted, the controller 135 feeds the sheet P from the sheet feeding cassette 101B. When the sheet is fed, the next sheet P2 is picked up before the first sheet P1 is completely removed from the sheet feeding cassette 101 so that two sheets P1, P2 are partially overlapped.

Figure 20A:
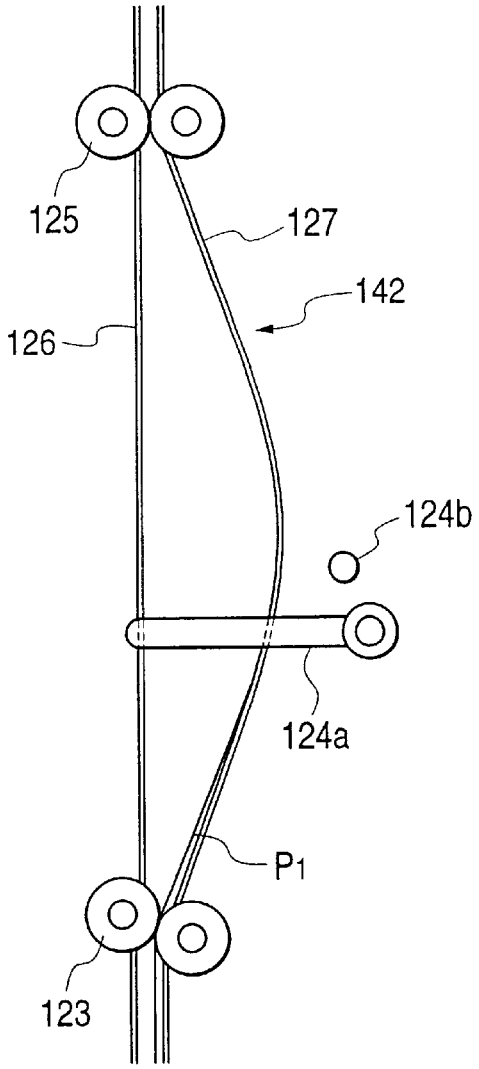
FIGS. 20A and 20B are views for explaining a leading end detecting operation of the image forming apparatus.

Then, when the leading end of the first sheet P1 fed in the overlapped condition passes through the longitudinal path portion 142, as shown in FIG. 20A, the leading end passes along the outer guide 127 due to the direction of the nip N of the upstream side conveying roller 123 directed outwardly. Namely, the leading end of the sheet P1 passes outwardly of the non-detection area of the leading end detection sensor 124.

Figure 20B:
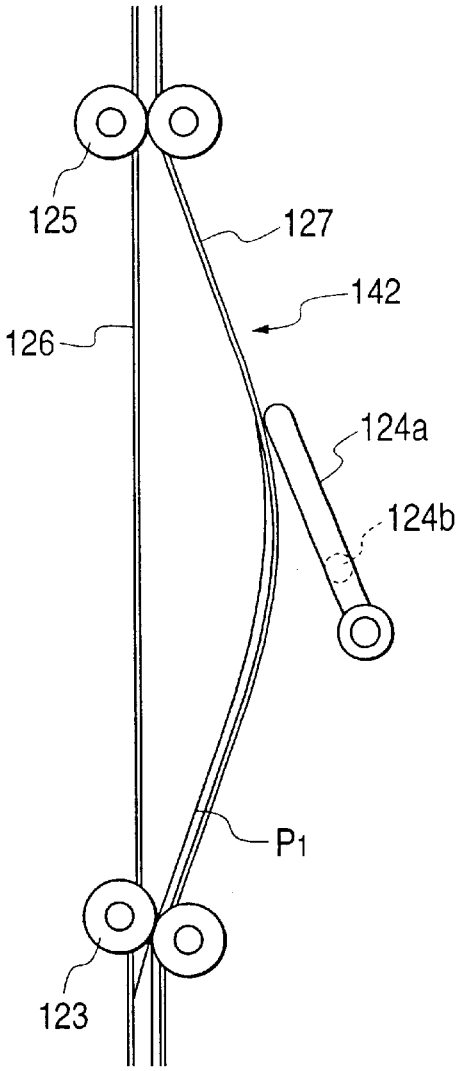

Then, the sheet P1 advances along the outer guide 127 and then pushes the sensor arm 124*a*. As a result, as shown in FIG. 20B, when the sensor arm 124*a* is rocked by an amount sufficient to detect the leading end of the sheet P1 by means of the leading end detection sensor 124, the interrupter 124*b* is turned ON accordingly, and, on the basis of the ON signal from the photo-interrupter 103*b*, the controller 135 detects the leading end of the first sheet P1 and effects the aforementioned registration in the conveying path 140 on the basis of the detection timing.

Incidentally, when the sensor arm 124*a* is pushed by the leading end of the sheet P1, it can be retarded sufficiently not to obstruct the further conveyance of the sheet P and can be returned to its original condition by itself.

On the other hand, after the leading end is detected, the controller 135 drives the upstream side conveying roller 123 and the downstream side conveying roller 125. Incidentally, when the first sheet P1 is conveyed by these rollers 123, 125, the sheet is conveyed at such a conveying speed that the slack in the first sheet P1 is removed before the second sheet P2 conveyed in the overlapped condition reaches the vicinity of the leading end detection sensor. Since this is selected on the basis of the above-mentioned relationship (2), detailed explanation thereof will be omitted.

Figure 21A:
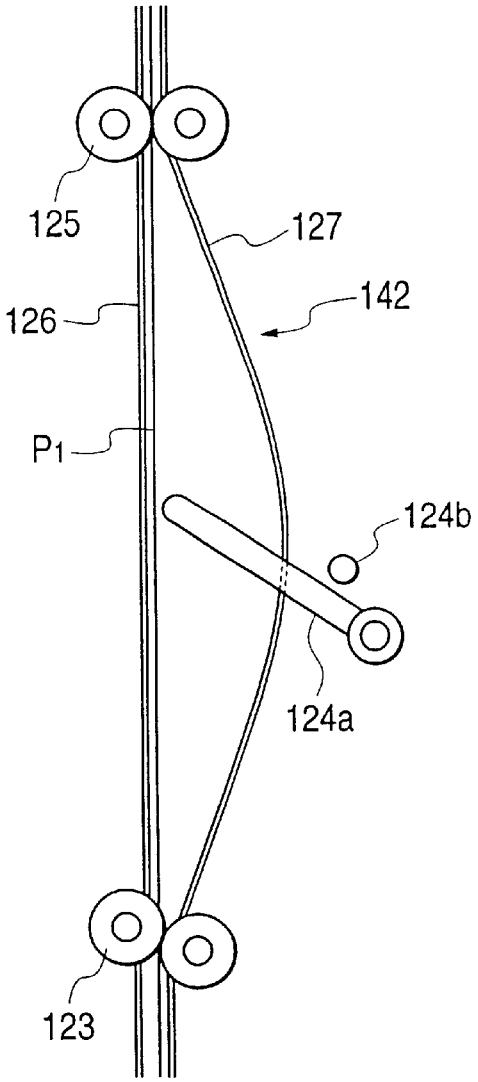
FIGS. 21A and 21B are views for explaining a leading end detecting operation of the image forming apparatus.

When the slack is removed from the first sheet P1 in this way, i.e., when the first sheet P1 is conveyed along the inner guide 126 of the longitudinal path portion 142, as shown in FIG. 21A, the sensor arm 124*a* is rocked downwardly.

Figure 21B:
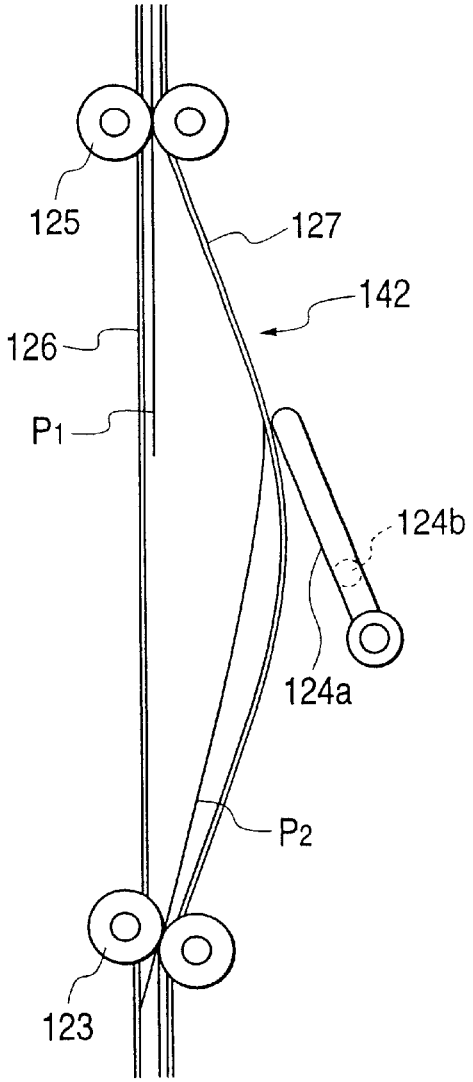
Figure 22A:
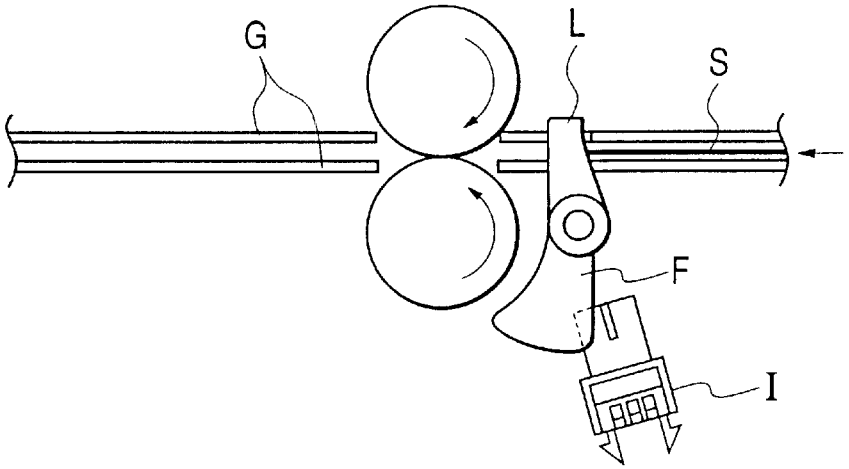
FIG. 22A PRIOR ART
FIGS. 22A and 22B are sectional view of a conventional sheet detecting means.
Figure 22B:
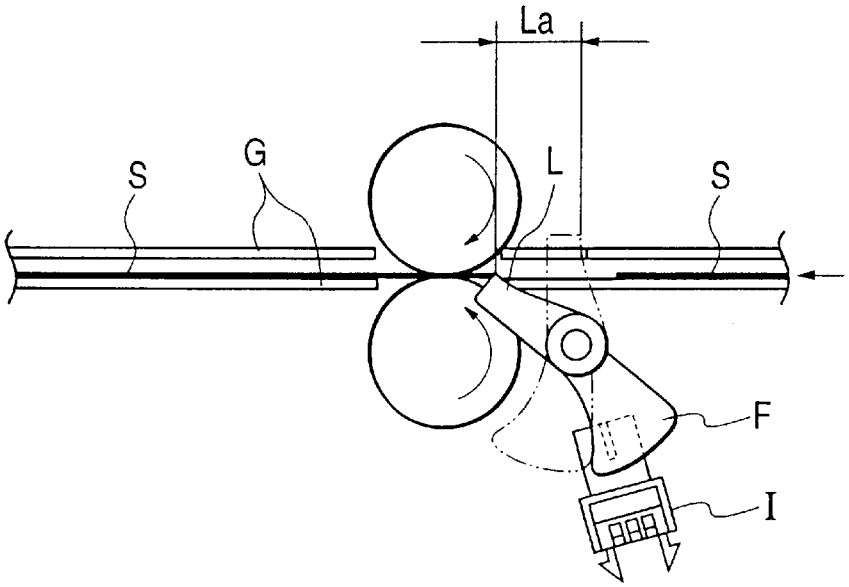
FIG. 22B PRIOR ART

Then, when the first sheet P1 is further conveyed, the second sheet P2 enters into the longitudinal path portion 142. The second sheet P2 is conveyed along the outer guide 127. When the sensor arm 124*a* is pushed by the leading end of the sheet P2 to rock the sensor arm 124*a* as shown in FIG. 21B, the photo-interrupter 124 is turned ON. In this way, the controller 135 detects the leading end of the second sheet P2. Incidentally, regarding a third sheet and so on, a leading end is detected by repeating the above operation.

In this way, after the preceding sheet P2 entered into the longitudinal path portion 142 is conveyed along the outer guide 127, the sheet is shifted along the inner guide 126, and the leading end of the next sheet P2 conveyed in the overlapped relationship to the preceding sheet P1 is temporarily spaced apart from the trailing end of the preceding sheet P1 in the longitudinal path portion. In this way, the leading end of the next sheet P2 can be detected positively.

The detection of the leading end detection sensor can be applied to various controls such as control for controlling the conveying amount to maintain a constant amount of the loop formed in front of the registration means to correct the skew-feeding or control for detecting sheet jam, as well as the timing adjustment between the image forming means and the sheet.

In the above-mentioned embodiments, while the optical sensors were explained, for example, a detecting means of pressure detecting type, a detecting means utilizing a Doppler effect, or a switch of electrical contact type may be used.

In the above-mentioned embodiments, while the conveying machine was explained as the image forming apparatus, the present invention can be applied to any apparatuses for conveying a cut sheet such as a printer, a facsimile or a printing device, as well as the image forming apparatus. Further, the present invention can also be applied to an auto document feeder for automatically feed an original in a copying machine.

What is claimed is:

1. A sheet conveying apparatus comprising:

a sheet feeding means for separating and feeding stacked sheets one by one;

a convey guide means for guiding the sheet fed out by said sheet feeding means;

a spacing means provided on said guide means that deviates positions of a trailing end of a preceding sheet and a leading end of a succeeding sheet which is fed continuously to the preceding sheet; and a sheet detecting means for detecting the leading end of the succeeding sheet deviated from the trailing end of the preceding sheet by said spacing means.

2. A sheet conveying apparatus according to claim 1, wherein said spacing means separates the trailing end of the preceding sheet from the leading end of the succeeding sheet by flexing the preceding sheet and by flexing the succeeding sheet when the flexion of the preceding sheet is released.

3. A sheet conveying apparatus according to claim 1, wherein said spacing means includes a guide member provided on said convey guide means and adapted to form a stepped portion, and said sheet detecting means is provided in association with said stepped portion.

4. A sheet conveying apparatus according to claim 3, wherein said convey guide means has a first guide for guiding one surface of the sheet, and a second guide for guiding the other surface of the sheet, and said spacing means has the stepped portion formed on said second guide and having a configuration directing downwardly at a down stream side in a sheet conveying direction so that, when the trailing end of the preceding sheet has passed said stepped portion, the trailing end of the preceding sheet is shifted along the downwardly directed portion of said second guide, thereby spacing the trailing end apart from the leading end of the succeeding sheet.

5. A sheet conveying apparatus according to claim 4, further comprising an inclined portion provided on said first guide and directing downwardly toward the downstream side in the sheet conveying direction, in order to guide the leading end of the preceding sheet toward the downwardly directed portion of said second guide.

6. A sheet conveying apparatus according to claim 4, wherein said sheet detecting means can detect the leading end of the succeeding sheet conveyed to said stepped portion and is disposed so that the trailing end of the preceding sheet deviated by said stepped portion is not detected.

7. A sheet conveying apparatus according to claim 6, wherein said sheet detecting means comprises a sensor lever rotated by the sheet, a flag provided on said sensor lever, and a photo-interrupter for detecting the end of the sheet by judging whether said flag exists between a light emitting portion and a light receiving portion, and wherein said sensor lever can be rotated when pushed by the sheet and is disposed not to contact with the sheet the trailing end of which has passed said stepped portion.

8. A sheet conveying apparatus according to claim 4, further comprising an auxiliary means for directing the trailing end of the sheet toward the downwardly directed portion of said second guide.

9. A sheet conveying apparatus according to claim 8, wherein said auxiliary means has a fan for generating air blow to bias the trailing end of the preceding sheet toward the downwardly directed portion of said second guide.

10. A sheet conveying apparatus according to claim 8, wherein said auxiliary means has a power supply for charging said convey guide means to attract the trailing end of the preceding sheet toward the downwardly directed portion of said second guide.

11. A sheet conveying apparatus according to claim 8, wherein said auxiliary means comprises a pair of conveying rollers disposed at a downstream side of said stepped portion in a sheet conveying direction and having a nip a tangential line of which is inclined with respect to the conveying direction, and wherein, when the sheet is conveyed by said pair of conveying rollers, the trailing end of the preceding sheet is directed along the downwardly directed portion of said second guide.

12. A sheet conveying apparatus according to claim 1, wherein said spacing means includes two opposed guide members cooperating to form a convey path, one of said guide member having a swollen portion, a first conveying means for entering a sheet from a sheet containing portion into said convey path, and a second conveying means for conveying the sheet entered into said convey path to an image forming portion, and wherein, after the preceding sheet entered into said convey path is conveyed along said swollen portion, the trailing end of the preceding sheet is separated from the leading end of the succeeding sheet by conveying the preceding sheet along the other of said two opposed guide members after the preceding sheet leaves said first conveying means.

13. A sheet conveying apparatus according to claim 12, wherein a sheet conveying speed of said second conveying means is selected to be greater than a sheet conveying speed of said first conveying means so that the preceding sheet conveyed along said swollen portion is directed along the other of said two opposed guide members.

14. A sheet conveying apparatus according to claim 12, wherein said sheet detecting means does not detected the preceding sheet conveying along the other of said two guide members.

15. A sheet conveying apparatus according to claim 12, further comprising a retractable skew-feeding correction member disposed at a downstream side of said convey path and adapted to curve the preceding sheet along said swollen portion by abutting against the preceding sheet entered into said swollen portion, thereby correcting the skew-feeding of the preceding sheet.

16. A sheet conveying apparatus according to claim 12, wherein the other of said two guide members forming said convey path is formed in a substantially straight shape, and a sheet conveying direction of said first conveying means is directed along said guide member having said swollen portion.

17. A sheet conveying apparatus according to claim 1, wherein said sheet feeding means comprises a pick-up roller for feeding out the sheet, a conveying roller for conveying the fed-out sheet, and a retard roller engageable with said conveying roller and capable of conveying the sheet in a direction opposite to a sheet conveying direction, so that a distance between adjacent sheets continuously fed is set to zero by feeding the sheets continuously by said pick-up roller.

18. A sheet conveying apparatus according to claim 1, wherein said sheet feeding means feeds the sheets in such a manner that a distance between adjacent sheets continuously fed becomes zero or that the trailing end of the preceding sheet is overlapped with the leading end of the succeeding sheet by a predetermined amount.

19. An image forming apparatus comprising:

a sheet feeding means for separating and feeding stacked sheets one by one;

a convey guide means for guiding the sheet fed out by said sheet feeding means;

a spacing means provided on said guide means and that deviates positions of a trailing end of a preceding sheet and a leading end of a succeeding sheet which is fed continuously to the preceding sheet;

a sheet detecting means for detecting the leading end of the succeeding sheet deviated from the trailing end of the preceding sheet by said spacing means;

a control means for controlling conveyance of the sheet on the basis of a result from said sheet detecting means; and an image forming means for forming an image on the sheet controlled by said control means.

* * * * *

UNITED STATES PATENT AND TRADEMARK OFFICE

CERTIFICATE OF CORRECTION

PATENT NO. : 6,409,043 B1
DATED : June 25, 2002
INVENTOR(S) : Takashi Fujita et al.

It is certified that error appears in the above-identified patent and that said Letters Patent is hereby corrected as shown below:

Column 1,
Line 31, "synchronous" should read -- synchronism --.

Column 3,
Line 25, "view" should read -- views --.

Column 5,
Line 46, "he" should read -- the --.

Column 7,
Line 44, "angle a" should read -- angle α --.

Column 9,
Line 67, "returned" should read -- return --.

Column 12,
Line 67, "not" should be deleted.
Line 67, "less" should read -- little --.

Column 14,
Line 13, "feed" should read -- feeding --.

Signed and Sealed this

Twenty-ninth Day of October, 2002

*Attest:*

*Attesting Officer*

JAMES E. ROGAN
*Director of the United States Patent and Trademark Office*